US009434159B2

(12) United States Patent
Nakazawa et al.

(10) Patent No.: US 9,434,159 B2
(45) Date of Patent: Sep. 6, 2016

(54) LIQUID DISCHARGING APPARATUS

(71) Applicant: Seiko Epson Corporation, Tokyo (JP)

(72) Inventors: Yoshio Nakazawa, Chino (JP); Kazuhito Fujisawa, Minowa (JP); Masahiko Yoshida, Shiojiri (JP); Atsushi Akiyama, Shiojiri (JP); Osamu Shinkawa, Chino (JP)

(73) Assignee: Seiko Epson Corporation (JP)

( * ) Notice: Subject to any disclaimer, the term of this patent is extended or adjusted under 35 U.S.C. 154(b) by 90 days.

(21) Appl. No.: 14/457,486

(22) Filed: Aug. 12, 2014

(65) Prior Publication Data

US 2015/0054876 A1 Feb. 26, 2015

(30) Foreign Application Priority Data

Aug. 22, 2013 (JP) ..... 2013-172709

(51) Int. Cl.
*B41J 29/38* (2006.01)
*B41J 29/393* (2006.01)
*B41J 2/045* (2006.01)

(52) U.S. Cl.
CPC ..... *B41J 2/04581* (2013.01); *B41J 2/04541* (2013.01); *B41J 2/04573* (2013.01)

(58) Field of Classification Search
CPC ..... B41J 2/0455; B41J 2/04581; B41J 2/30; B41J 2/04501; B41J 2/04541; B41J 2/3558; H03F 3/45475
USPC ..... 347/14
See application file for complete search history.

(56) References Cited

U.S. PATENT DOCUMENTS 7,150,513 B2 12/2006 Shinkawa et al.
2010/0117732 A1* 5/2010 Tabata ..... H03F 3/217 330/251
2011/0242172 A1* 10/2011 Yoshino ..... B41J 2/04541 347/10
2011/0254887 A1* 10/2011 Ide ..... B41J 2/04541 347/10
2014/0267488 A1* 9/2014 Ready ..... B41J 2/175 347/19

FOREIGN PATENT DOCUMENTS

JP 2004-276544 A 10/2004

* cited by examiner

*Primary Examiner* — Matthew Luu
*Assistant Examiner* — Patrick King
(74) *Attorney, Agent, or Firm* — Harness, Dickey & Pierce, P.L.C.

(57) ABSTRACT

An ink jet printer is provided with a piezoelectric element which is provided corresponding to a pressure chamber in order to discharge liquid droplets, a driving signal generating section which generates a driving signal, a residual vibration detecting section which detects changes in an electromotive force of the piezoelectric element in accordance with the residual vibration inside the pressure chamber which occur after the driving signal is applied, a first switch which switches whether or not a driving signal is applied to the piezoelectric element, and a second switch which switches whether or not a change in the electromotive force is supplied to a first high-pass filter, where the second switch and the residual vibration detecting section are connected via a first capacitor of the first high-pass filter.

4 Claims, 27 Drawing Sheets

EXPERIMENTAL VALUES AND CALCULATED VALUES OF RESIDUAL VIBRATION (WHEN NORMAL)

EXPERIMENTAL VALUES AND CALCULATED VALUES OF RESIDUAL VIBRATION (BUBBLES)

EXPERIMENTAL VALUES AND CALCULATED VALUES OF RESIDUAL VIBRATION (DRYING)

EXPERIMENTAL VALUES AND CALCULATED VALUES OF RESIDUAL VIBRATION (PAPER DUST)

BEFORE PAPER DUST ATTACHMENT

AFTER PAPER DUST ATTACHMENT

| STATE NO. | NTc FLAG | NTf FLAG | NTc | NTf | DETERMINATION RESULT |
|---|---|---|---|---|---|
| 0 | VALID | VALID | SHORT | NORMAL | BUBBLES |
| 1 | | | | LONG AND SHORT | |
| 2 | | | NORMAL | NORMAL | NORMAL |
| 3 | | | | LONG AND SHORT | BUBBLES |
| 4 | | | LONG | NORMAL | THICKENING |
| 5 | | | | LONG AND SHORT | |
| 6 | INVALID | VALID | INVALID | NORMAL | INK OMISSIONS |
| 7 | | | | LONG AND SHORT | |
| 8 | INVALID | INVALID | INVALID | INVALID | INK OMISSIONS |

LIQUID DISCHARGING APPARATUS

BACKGROUND

1. Technical Field

The invention relates to inspecting a discharge state of a liquid discharging apparatus.

2. Related Art

Ink jet type printers perform printing by discharging ink inside a cavity. The ink thickens after drying. When the ink inside the cavity is thickened, there are times when this causes discharge failures. In addition, when bubbles are included in the ink inside the cavity or when paper dust is attached to the nozzles which discharge the ink, there are times when this causes discharge failures. Thus, it is preferable to inspect the discharge state of the ink.

JP-A-2004-276544 (FIG. 31) discloses a method where the discharge state is determined by applying vibration to the ink inside the cavity using a piezoelectric element and detecting the behavior of ink with respect to the residual vibration thereof.

Here, the behavior of the ink is detected according to electromotive force of the piezoelectric element. Accordingly, it is necessary to apply a driving signal for inspecting the piezoelectric element in the step where the vibration is applied to the ink and to extract the electromotive force from the piezoelectric element in the step where the residual vibration of the ink is inspected. In more detail, JP-A-2004-276544 (FIG. 31) discloses a switch which selects a driver which supplies a driving signal and a head abnormality detecting unit which detects abnormalities in a head based on electromotive force and which connects the driver and the head abnormality detecting unit with the piezoelectric element.

However, with respect to a driving signal which has a large amplitude, the electromotive force of the piezoelectric element according to the residual vibration has a small amplitude. Since the piezoelectric element has a capacitive load, the potential according to the driving signal is held by the piezoelectric element even when the supply of the driving signal is stopped. For this reason, the potential of the piezoelectric element which is supplied to the head abnormality detecting unit directly after switching from applying the driving signal to the detecting of the electromotive force is the potential of the driving signal directly before switching. Thus, there is a problem in that the dynamic range of the head abnormality detecting unit is inevitably increased and a high voltage is necessary for the power voltage which is necessary in the head abnormality detecting unit in the same manner as for the driver which outputs the driving signal.

SUMMARY

An advantage of some aspects of the invention is to provide a liquid discharging apparatus where it is possible to decrease a power voltage of a residual vibration detecting section which detects changes in an electromotive force of a piezoelectric element in accordance with residual vibration.

According to an aspect of the invention, there is provided a liquid discharging apparatus including a nozzle which discharges liquid droplets; a pressure chamber which communicates with the nozzle; a piezoelectric element which is provided corresponding to the pressure chamber in order to discharge liquid droplets; a driving signal generating section which generates a driving signal for driving the piezoelectric element; a first high-pass filter which includes a first capacitor and a first resistor; a residual vibration detecting section which detects changes, in an electromotive force of the piezoelectric element in accordance with the residual vibration inside the pressure chamber, which occur after the driving signal is applied; a first switch which is arranged so as to be able to switch whether or not the driving signal is applied to the piezoelectric element; a second switch which is arranged so as to be able to switch whether or not a change in the electromotive force is supplied to the first high-pass filter; a first node which electrically connects the piezoelectric element, the first switch, and the second switch; a second node which electrically connects the driving signal generating section and the first switch; and a third node which electrically connects the second switch and the first high-pass filter, in which changes in the electromotive force which are detected by the residual vibration detecting section are based on a first output signal which is passed through the first high-pass filter.

According to the aspect of the liquid discharging apparatus, the first output signal which passes through the first high-pass filter which includes the first capacitor is supplied to the residual vibration detecting section. Since the first high-pass filter removes the low frequency, the piezoelectric element and the residual vibration detecting section are AC coupled even when the second switch is in the on-state. For this reason, it is sufficient if the power voltage of the residual vibration detecting section corresponds to the electromotive force of the piezoelectric element even when the power voltage does not correspond to the dynamic range of the driving signal. Thus, since it is possible to lower the power voltage of the residual vibration detecting section and it is also sufficient if the residual vibration detecting section is operated at a low voltage, it is possible for the configuration to be simplified. In more detail, it is preferable that the power voltage of the residual vibration detecting section be lower than the maximum value of the amplitude of the driving signal.

In the aspect of the liquid discharging apparatus described above, it is preferable that a third resistor which is electrically connected between the second node and the third node be provided. In a case where the electromotive force from the piezoelectric element is switched from the supplying of the driving signal to the piezoelectric element to the supplying to the residual vibration detecting section, when the potential of the third node is changed, switching noise is generated. According to this aspect, since it is possible to bias the potential of the third node according to the driving signal, it is possible to suppress changes in the potential of the third node even with the switching described above. Thus, it is possible to suppress the generation of the switching noise and to accurately detect the residual vibration. Additionally, it is possible to convert the current into voltage by a current which is generated by the piezoelectric element flowing through the third resistor.

In the aspect of the liquid discharging apparatus described above, it is preferable that a fixed potential be supplied to another terminal of the first resistor, and that a third switch which is provided in parallel with the first resistor be provided. According to this aspect, by setting the third switch to an on-state, it is possible to prevent a signal with a large amplitude being input into the residual vibration detecting section in a period where the residual vibration is not detected. Due to this, noise is not input into the residual vibration detecting section. In particular, it is possible to lower the breakdown voltage of elements which configure the residual vibration detecting section by setting the fixed potential to within a range of the power potential of the residual vibration detecting section. Furthermore, since it is possible to reduce the changes in the potential of the input signal of the residual vibration detecting section even when the third switch transitions from the on-state to the off-state by setting the fixed potential to a substantially central potential between a high power potential and a low power potential, it is possible to accurately detect the residual vibration without delay.

In the aspect of the liquid discharging apparatus described above, it is preferable that the residual vibration detecting section be provided with a low pass filter which attenuates a high frequency component of the first output signal. According to this aspect, it is possible to suppress the noise of high frequency components by limiting the frequency range for detecting the residual vibration.

In the aspect of the liquid discharging apparatus described above, it is preferable that the residual vibration detecting section be provided with a gain adjusting section which adjusts an amplitude of the first output signal. According to this aspect, it is possible to adjust the final gain.

In the aspect of the liquid discharging apparatus described above, it is preferable that the residual vibration detecting section be provided with a buffer amp which outputs a detection signal with low impedance by supplying the first output signal and converting the impedance. According to this aspect, it is possible to adjust the impedance using the buffer amp, additionally, it is possible to prevent the signal from flowing back to the residual vibration detecting section from downstream.

In the aspect of the liquid discharging apparatus described above, it is preferable that the liquid discharging apparatus have a second high-pass filter which includes a second capacitor and a second resistor, where the residual vibration detecting section is provided with a differential amplifier which has a positive input terminal and a negative input terminal, one out of the first output signal and a second output signal which passes through the second high-pass filter is supplied to the positive input terminal of the differential amplifier and the other out of the first output signal and the second output signal is supplied to the negative input terminal of the differential amplifier, and the driving signal or a fixed potential which is supplied to the piezoelectric element is input to the second high-pass filter.

According to this aspect, in a case where the driving signal is supplied to the second high-pass filter, it is possible to differentially amplify the voltage at both ends of the third resistor. On the other hand, in a case where a fixed potential which is supplied to the piezoelectric element is input to the second high-pass filter, it is possible to cancel the power noise which is superimposed on the fixed potential by differential amplification.

In the aspect of the liquid discharging apparatus described above, it is preferable that states of the first switch and the second switch include a first state where the first switch is on and the second switch is off, a second state where the first switch is on and the second switch is on, and a third state where the first switch is off and the second switch is on, and that the first switch and the second switch be controlled in order of the first state, the second state, and the third state, or in order of the third state, the second state, and the first state.

According to this aspect, after the third node is biased by the potential of the driving signal via the second switch in the second state, the first switch is changed from the on-state to the off-state in the third state. For this reason, the potential of the third node is hardly changed. Thus, it is possible to greatly reduce the switching noise.

In addition, after the potential of the driving signal is supplied to the piezoelectric element via the first switch in the second state, the second switch is changed from the on-state to the off-state in the first state. For this reason, the potential of the first node is hardly changed. Thus, it is possible to suppress the switching noise from being superimposed on the driving signal which is supplied to the piezoelectric element.

In the aspect of the liquid discharging apparatus described above, it is preferable that states of the first switch, the second switch, and the third switch include a first state where the first switch is on, the second switch is off, and the third switch is on, a second state where the first switch is on, the second switch is on, and the third switch is on, and a third state where the first switch is off, the second switch is on, and the third switch is off, and that the first switch, the second switch, and the third switch be controlled in order of the first state, the second state, and the third state, or the third state, the second state, and the first state.

According to this aspect, since clamping is carried out in the first state and the second state and the clamping is released in the third state, after noise with a high amplitude which is input from the high-pass filter in the first state is cut out and the third node is biased by the potential of the driving signal via the second switch in the second state, the first switch is changed from the on-state to the off-state in the third state and the clamping is released. For this reason, the potential of the third node is hardly changed and it is possible to accurately detect residual vibration by greatly reducing switching noise.

BRIEF DESCRIPTION OF THE DRAWINGS

The invention will be described with reference to the accompanying drawings, wherein like numbers reference like elements.

DESCRIPTION OF EXEMPLARY EMBODIMENTS

Below, detailed description will be given of favorable embodiments of a liquid discharging apparatus according to an aspect of the invention. Here, the embodiments are given as examples and the content of the invention should not be interpreted as limited by the embodiments. Here, in the present embodiment below, description will be given using an ink jet printer, which prints an image onto recording paper (a droplet receiving object) by discharging ink (a liquid material), as an example.

First Embodiment

Figure 1:
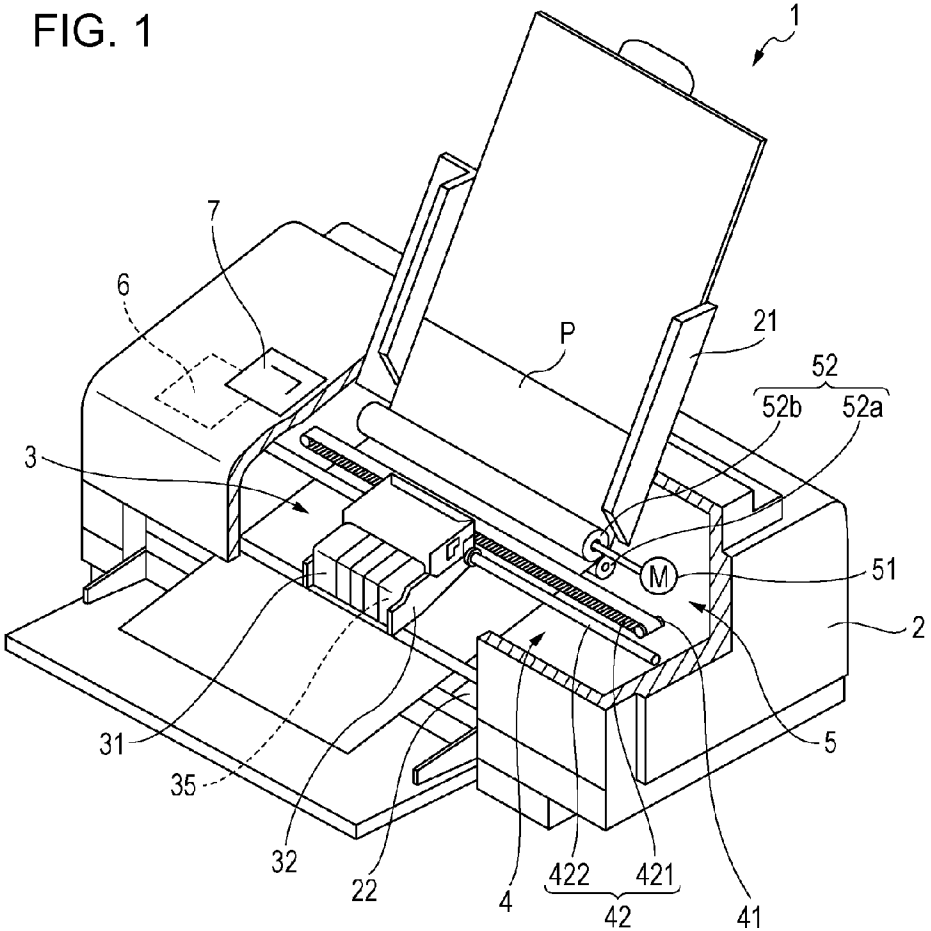
FIG. 1 is a schematic diagram which shows a configuration of an ink jet printer which is one type of liquid discharging apparatus according to an aspect of the invention.

FIG. 1 is a schematic diagram which shows a configuration of an ink jet printer 1 which is one type of liquid discharging apparatus in the first embodiment of the invention. Here, in the description below, the upper side in FIG. 1 is referred to as an "upper section" and the lower side is referred to as a "lower section". Firstly, description will be given of a configuration of the ink jet printer 1.

The ink jet printer 1 shown in FIG. 1 is provided with an apparatus body 2, a tray 21 where recording paper P is set to the rear of the upper section, a paper discharging opening 22 which discharges the recording paper P to the front of the lower section, and an operation panel 7 on an upper section surface.

The operation panel 7 is configured of, for example, a liquid crystal display, an organic EL display, an LED lamp, and the like, and is provided with a display section (which is not shown in the diagram) which displays an error message or the like and an operation section (which is not shown in the diagram) which is configured of various types of switches and the like. The display section of the operation panel 7 functions as a notification unit.

In addition, the inside of the apparatus body 2 mainly has a printing apparatus (a printing unit) 4 which is provided with a print unit (a moving body) 3 which moves back and forth, a paper feeding apparatus (a droplet receiving object transport unit) 5 which supplies and discharges the recording paper P with respect to the printing apparatus 4, and a control section (a control unit) which controls the printing apparatus 4 and the paper feeding apparatus 5.

Under the control of the control section 6, the paper feeding apparatus 5 intermittently sends the recording paper P sheet by sheet. The recording paper P passes through the vicinity of the lower section of a print section 3. At this time, printing onto the recording paper P is performed by the print section 3 moving back and forth in a direction which intersects substantially orthogonally with the sending direction of the recording paper P. That is, ink jet type printing is performed by the back and forth movement of the print section 3 and the intermittent sending of the recording paper P which are the main scanning and the sub-scanning in the printing.

The printing apparatus 4 is provided with the print section 3, a carriage motor 41 which is a driving source which moves (back and forth movement) the print section 3 in the main scanning direction, and a back and forth movement mechanism 42 which moves the print section 3 back and forth by receiving rotation of the carriage motor 41.

The print section 3 has a plurality of head units 35, an ink cartridge (I/C) 31 which supplies ink to each of the head units 35, and a carriage 32 where each of the head units 35 and the ink cartridge 31 are mounted. Here, in a case of an ink jet printer with a high ink consumption, the ink jet printer may be configured such that the ink cartridge 31 is set in another place without being mounted on the carriage 32 and ink is supplied through communication with the head unit 35 using a tube (which is not shown in the diagram).

Here, full color printing is possible by using an ink cartridge, which is filled with four colors of ink which are yellow, cyan, magenta, and black, as the ink cartridge 31. In this case, the head units 35 which correspond to each of the colors (detailed description will be given of this configuration later) are provided in the print section 3. Here, four ink cartridges 31 which correspond to the four colors of ink are shown in FIG. 1; however, the print section 3 may be configured such that the ink cartridges 31 of other colors, for example, such as light cyan, light magenta, dark yellow, or special inks, are further provided.

The back and forth moving mechanism 42 has a carriage guide shaft 422 of which both ends are supported by a frame (which is not shown in the diagram), and a timing belt 421 which extends in parallel with the carriage guide shaft 422.

The carriage 32 is supported by the carriage guide shaft 422 of the back and forth moving mechanism 42 so as to be able to freely move back and forth and is also fixed to a part of the timing belt 421.

According to the operation of the carriage motor 41, when the timing belt 421 is made to travel forward and backward via a pulley, the print section 3 moves back and forth by being guided by the carriage guide shaft 422. Then, printing onto the recording paper P is performed by ink droplets being appropriately discharged from each of ink jet heads 100 of the head unit 35 in correspondence with image data (printing data) to be printed at the time of this back and forth movement.

The paper feeding apparatus 5 has a paper feeding motor 51 which is a driving source thereof and a paper feeding roller 52 which rotates according to the operation of the paper feeding motor 51.

The paper feeding roller 52 is configured of a driven roller 52*a* and a driving roller 52*b* which are vertically opposed to each other while interposing the transport path (the recording paper P) of the recording paper P, and the driving roller 52*b* is linked to the paper feeding motor 51. Due to this, the paper feeding roller 52 sends a large number of sheets of the recording paper P which is set in the tray 21 one by one toward the printing apparatus 4 or discharges the sheets one by one from the printing apparatus 4. Here, the configuration may be a configuration where it is possible to mount a paper feeding cassette which accommodates the recording paper P so as to be freely attached and detached, instead of the tray 21.

Furthermore, the paper feeding motor 51 also performs paper feeding of the recording paper P according to the resolution of an image by working with the back and forth operation of the print section 3. It is possible to perform each of the paper feeding operation and the paper sending operation using different motors and it is also possible to perform the operations using the same motor depending on the part which switches the torque transmission, such as an electromagnetic clutch.

The control section 6 performs a printing process onto the recording paper P by controlling the printing apparatus 4, the paper feeding apparatus 5, or the like based on printing data which is input, for example, from a host computer 8 such as a personal computer (PC), or a digital camera (DC). In addition, the control section 6 displays an error message or the like on the display section of the operation panel 7 or lights/flashes an LED lamp or the like and at the same time, executes a corresponding process in each of the sections based on pressing signals from various types of switches which are input from the operation section. Furthermore, there are also times when the control section 6 transfers information such as an error message or about a discharge abnormality to the host computer 8 as necessary.

Figure 2:
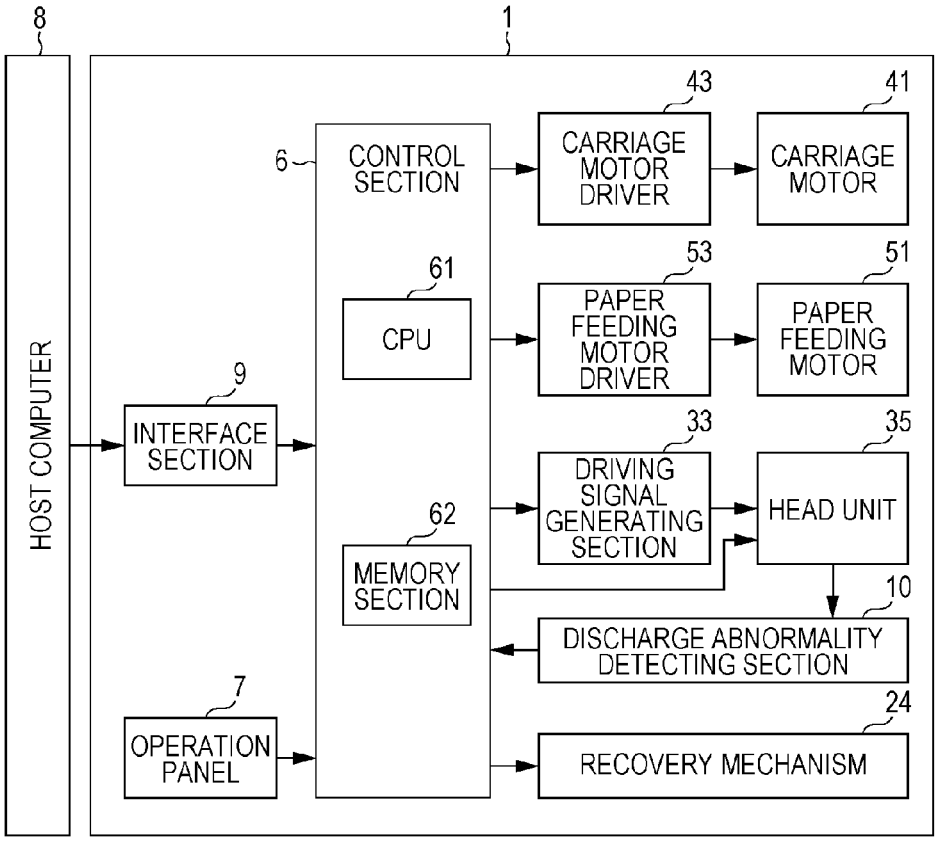
FIG. 2 is a block diagram which schematically shows main sections of the ink jet printer according to an aspect of the invention.

FIG. 2 is a block diagram which schematically shows main sections of the ink jet printer of the invention. In this FIG. 2, the ink jet printer 1 of the invention is provided with an interface section 9 which receives printing data or the like which is input from the host computer 8, the control section 6, the carriage motor 41, a carriage motor driver 43 which drives and controls the carriage motor 41, the paper feeding motor 51, a paper feeding motor driver 53 which drives and controls the paper feeding motor 51, the head unit 35, a driving signal generating section 33 which drives and controls the head unit 35, a discharge abnormality detecting section 10, a recovery mechanism 24, and the operation panel 7.

The recovery mechanism 24 is a mechanism for recovering functionality in order for the head unit 35 to operate normally in a case where it is not possible to discharge ink droplets from the head unit 35. Specifically, the recovery mechanism 24 executes a flushing operation or a wiping operation. The flushing operation is a head cleaning operation which discharges ink droplets from all of nozzles 110 of the head unit 35 or from a target nozzle 110 when a cap of the head unit 35 is mounted or in a place where the ink droplets do not land on the recording paper. In addition, in the wiping movement, attached material (paper dust, dirt, or the like) which is attached to the head surface is wiped off by a wiper in order to clean the nozzle plate. At this time, there is a possibility that the pressure inside of the nozzle 110 will become negative and ink of another color will be drawn in. Thus, the flushing operation is carried out by discharging a certain amount of ink droplets from all of the nozzles 110 of the head unit 35 after the wiping operation.

Here, detailed description will be given of the discharge abnormality detecting section 10 and the driving signal generating section 33.

In FIG. 2, the control section 6 is provided with a Central Processing Unit (CPU) 61 which executes various types of processes such as a printing process or a discharge abnormality detecting process, and a memory section 62. The memory section 62 is provided with an Electrically Erasable Programmable Read-Only Memory (EEPROM) which is one type of non-volatile semiconductor memory which stores printing data which is input from the host computer 8 via the interface section 9 in a data storing region which is not shown in the diagram, a Random Access Memory (RAM) which temporarily stores various types of data when a discharge abnormality detecting process or the like to be described later is executed or which temporarily runs an application program such as a printing process, and a PROM which is one type of non-volatile semiconductor memory which stores a control program or the like which controls each of the sections. Here, each of the constituent components of the control section 6 is electrically connected via a bus which is not shown in the diagram.

The print section 3 is provided with a plurality of the head units 35 which correspond to each color of ink as described above. In addition, each of the head units 35 is provided with a plurality of the nozzles 110 and piezoelectric elements 200 which correspond to each of these nozzles 241. That is, the head unit 35 has a configuration which is provided with a plurality of the ink jet heads 100 (droplet discharging heads) which have one set of the nozzles 241 and the piezoelectric elements 200.

In addition, although not shown in the diagram, various types of sensors which are able to detect, for example, residual amounts of ink in the ink cartridges 31, the position of the print section 3, the printing environment such as the temperature and humidity, and the like are each electrically connected with the control section 6.

When the control section 6 obtains printing data from the host computer 8 via the interface section 9, the control section 6 stores the printing data in the memory section 62. Then, the CPU 61 executes a predetermined process on the printing data and outputs a control signal to the driving signal generating section 33, each of the drivers 43 and 53, and the head unit 35 based on the processed data and the input data from the various types of sensors. When these control signals are input via each of the drivers 43 and 53, the carriage motor 41 and the paper feeding apparatus 5 of the printing apparatus 4 are each operated. Due to this, a printing process is executed on the recording paper P.

Figure 3:
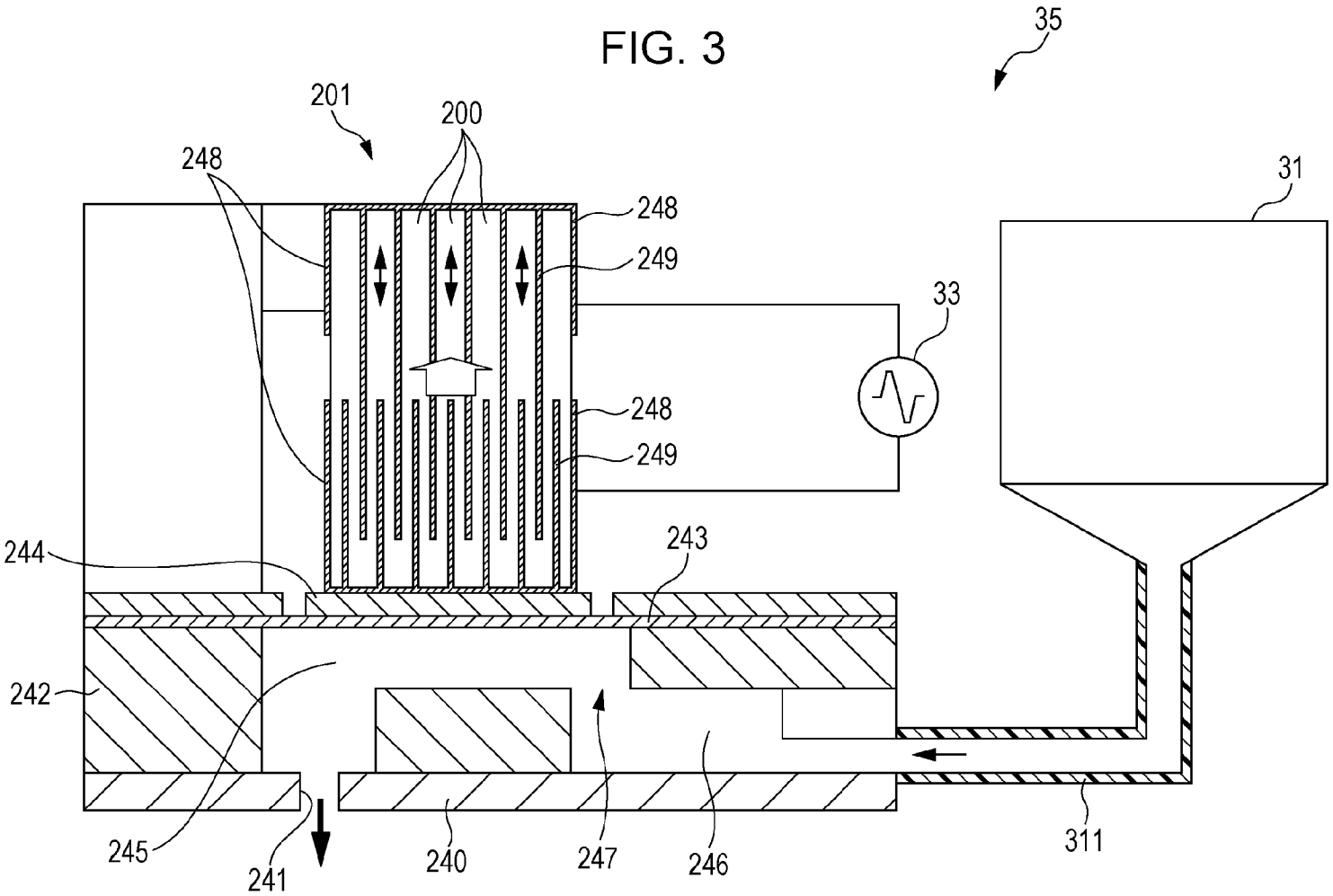
FIG. 3 is a schematic cross-sectional diagram which shows an example of a head unit (an ink jet head) in the ink jet printer shown in FIG. 1.
Figure 4:
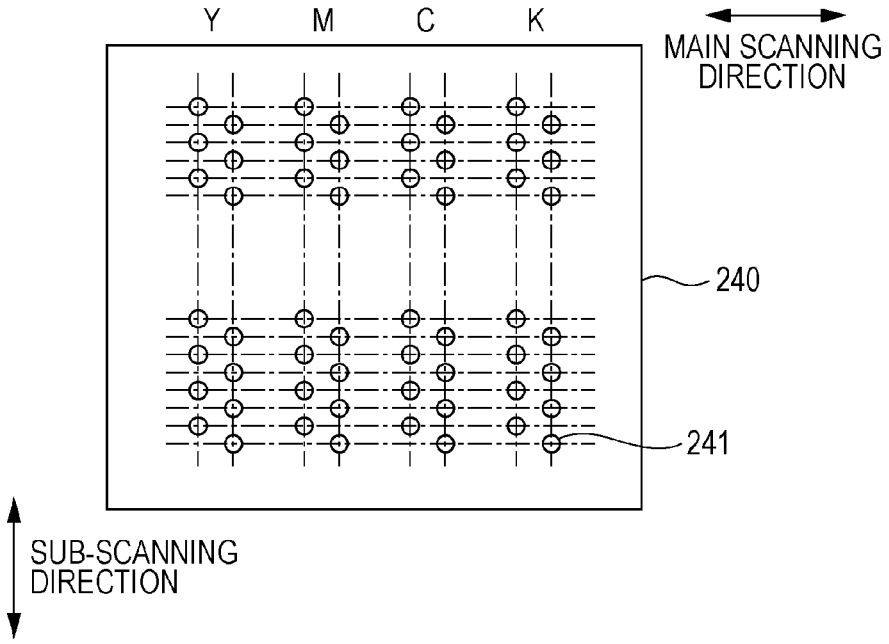
FIG. 4 is an example of a nozzle arrangement pattern on a nozzle plate in the head unit which uses ink with four colors.

Next, structures of each of the head units 35 will be described. FIG. 3 is a schematic cross-sectional diagram of the head unit 35 (the ink jet head 100) shown in FIG. 1 and FIG. 4 is a planar diagram which shows an example of the nozzle surface of the print section 3 to which the head unit 35 shown in FIG. 3 is applied.

The head unit 35 shown in FIG. 3 discharges ink (liquid) inside a cavity 245 from nozzles 241 according to the driving of the piezoelectric element 200. The head unit 35 is provided with a nozzle plate 240 where the nozzle 241 is formed, a cavity plate 242, a diaphragm 243, and a laminated piezoelectric element 201 where a plurality of piezoelectric elements 200 are laminated.

The cavity plate 242 is formed in a predetermined shape (a shape which forms a concave section), and the cavity 245 and a reservoir 246 are formed due to this. The cavity 245 and the reservoir 246 communicate with each other via an ink supply opening 247. In addition, the reservoir 246 communicates with the ink cartridge 31 via an ink supply tube 311.

The lower end of the laminated piezoelectric element 201 in FIG. 3 is bonded with the diaphragm 243 via an intermediate layer 244. A plurality of external electrodes 248 and inner electrodes 249 are bonded with the laminated piezoelectric element 201. That is, the external electrodes 248 are bonded with the external surface of the laminated piezoelectric element 201 and the inner electrodes 249 are set between each of the piezoelectric elements 200 (or the inside of each of the piezoelectric elements) which configure the laminated piezoelectric element 201. In this case, portions of the external electrodes 248 and the inner electrodes 249 are arranged so as to alternately overlap in the thickness direction of the piezoelectric elements 200.

Then, by applying a driving voltage waveform from the driving signal generating section 33 to between the external electrodes 248 and the inner electrodes 249, the laminated piezoelectric element 201 vibrates by changing shape as shown by the arrow in FIG. 3 (expanding and contracting in the vertical direction in FIG. 3) and the diaphragm 243 vibrates due to this vibration. Due to the vibration of the diaphragm 243, the volume of the cavity 245 (the pressure inside the cavity) changes and ink (liquid) which is filled inside the cavity 245 is discharged from the nozzle 241 as liquid droplets.

The amount by which the liquid is reduced inside the cavity 245 due to the discharging of the liquid droplets is refilled by ink being supplied from the reservoir 246. In addition, ink is supplied to the reservoir 246 from the ink cartridge 31 via the ink supply tube 311.

Here, the arrangement pattern of the nozzles 241 which are formed on the nozzle plate 240 shown in FIG. 3 is arranged to be shifted by one step, for example, as in the nozzle arrangement pattern shown in FIG. 4. In addition, the pitch between the nozzles 110 may be appropriately set according to the printing resolution (dpi: dots per inch). Here, in FIG. 5, the arrangement pattern of the nozzles 241 is shown in a case where four colors of ink (the ink cartridge 31) are applied.

Figure 5:
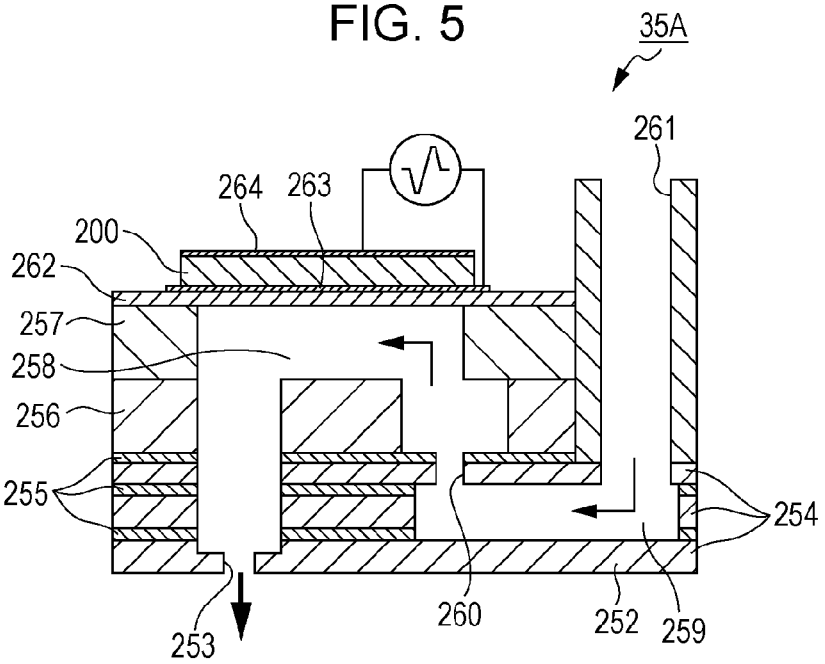
FIG. 5 is a schematic cross-sectional diagram which shows another example of a head unit.

Next, description will be given of another example of the head unit 35. A head unit 35A shown in FIG. 5 is a head unit where a diaphragm 262 vibrates due to the driving of the piezoelectric elements 200 and ink (liquid) inside a cavity 258 is discharged from nozzles 253. A metal plate 254 made of stainless steel is bonded via an adhesive film 255 with a nozzle plate 252 made of stainless steel where nozzles (holes) 253 are formed, and another metal plate 254 made of stainless steel is further bonded on top thereof via the adhesive film 255 in the same manner. Then, a communication opening forming plate 256 and a cavity plate 257 are sequentially bonded on top thereof.

The nozzle plate 252, the metal plate 254, the adhesive film 255, the communication opening forming plate 256, and the cavity plate 257 are each formed in predetermined shapes (shapes which form a concave section) and the cavity 258 and a reservoir 259 are formed by laying these on top of each other. The cavity 258 and the reservoir 259 communicate with each other via an ink supply opening 260. In addition, the reservoir 259 communicates with an ink inlet 261.

The diaphragm 262 is set in an upper surface opening section of the cavity plate 257 and the piezoelectric elements 200 are bonded with the diaphragm 262 via a lower electrode 263. In addition, an upper electrode 264 is bonded with the opposite side to the lower electrode 263 of the piezoelectric elements 200. In the driving signal generating section 33, the piezoelectric element 200 is vibrated by applying (supplying) a driving voltage waveform between the upper electrode 264 and the lower electrode 263 and the diaphragm 262 which is bonded with the piezoelectric element 200 vibrates. Due to the vibration of the diaphragm 262, the volume of the cavity 258 (the pressure inside the cavity) changes and ink (liquid) which is filled inside the cavity 258 is discharged from the nozzles 253 as liquid droplets.

The amount by which the liquid is reduced inside the cavity 258 due to the discharging of the liquid droplets is refilled by ink being supplied from the reservoir 259. In addition, ink is supplied to the reservoir 259 from the ink inlet 261.

Figure 6A:
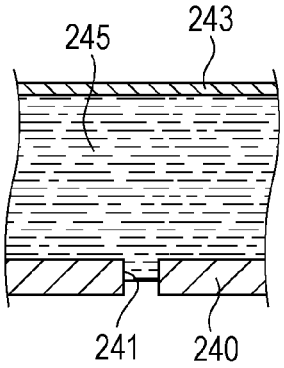
FIGS. 6A to 6C are state diagrams which shows each of the states of the head unit when a driving signal is input.
Figure 6B:
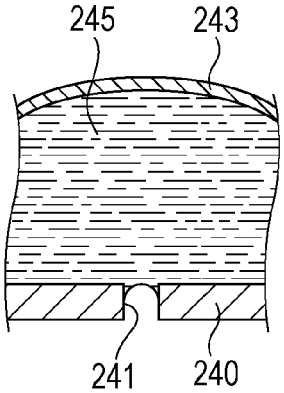
Figure 6C:
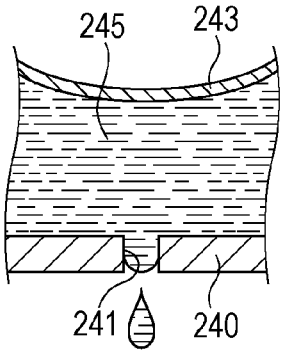

Next, description will be given of the discharging of ink droplets with reference to FIGS. 6A to 6C. When a driving voltage is applied to the piezoelectric element 200 shown in FIG. 3 (FIG. 5) from the driving signal generating section 33, mechanical forces such as expansion and contraction or bending are generated in the piezoelectric element 200. For this reason, the diaphragm 243 (262) is bent in the upward direction in FIG. 3 (FIG. 5) with respect to the initial state shown in FIG. 6A and the volume of the cavity 245 (258) is increased as shown in FIG. 6B. When the driving voltage is changed under the control of the driving signal generating section 33 in this state, the diaphragm 243 (262) is reset due to its own elastic restoration power and moves in a downward direction beyond the position of the diaphragm 243 (262) in the initial state, and the volume of the cavity 245 (258) shrinks rapidly as shown in FIG. 6C. At this time, some of the ink (liquid material) which fills the cavity 245 (258) is discharged as ink droplets from the nozzle 241 (253) which communicates with the cavity 245 (258) by compression pressure which is generated inside the cavity 245 (258).

The diaphragm 243 of each of the cavities 245 vibrates in an attenuated manner during the period from when the next driving signal (the driving voltage) is input until ink droplets are discharged again by a series of operations (ink discharging operations according to the driving signal of the driving signal generating section 33). Below, the attenuated vibration is also referred to as residual vibration. The residual vibration of the diaphragm 243 is estimated to have a natural oscillation frequency which is determined according to an acoustic resistance r according to the shape of the nozzle 241 or the ink supply opening 247, the ink viscosity, or the like, an inertance m due to the weight of the ink inside the flow path, and a compliance Cm of the diaphragm 243.

Figure 7:
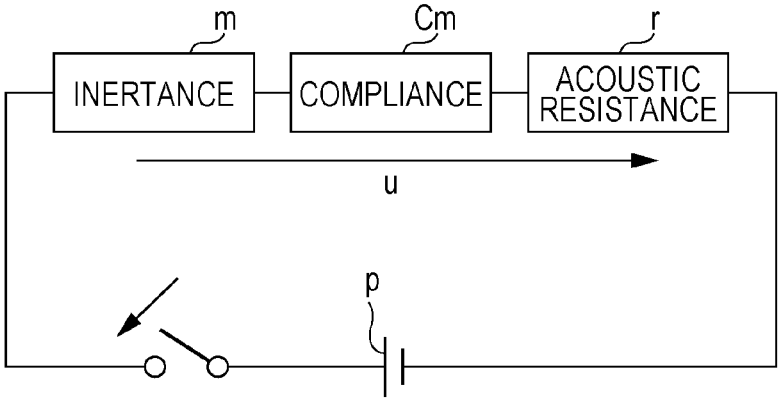
FIG. 7 is a circuit diagram which shows a calculation model of simple harmonic motion which estimates the residual vibration of a diaphragm in FIG. 3.

Description will be given of a model for calculating the residual vibration of the diaphragm 243 based on the estimation described above. FIG. 7 is a circuit diagram which shows a model for calculating simple harmonic motion which estimates the residual vibration of the diaphragm 243. Thus, the model for calculating the residual vibration of the diaphragm 243 is able to be represented by an acoustic pressure p, and the inertance m, the compliance Cm, and the acoustic resistance r described above. Then, when a volume velocity u of a step response when the acoustic pressure p is applied to a circuit in FIG. 7 is calculated, the following formula is obtained.

$$u=\{p/(\omega\cdot m)\}e^{-\omega t}\cdot\sin\omega t$$

$$\omega=\{1/(m\cdot Cm)-\alpha^2\}^{1/2}$$

$$\alpha=r/2m$$

Figure 8:
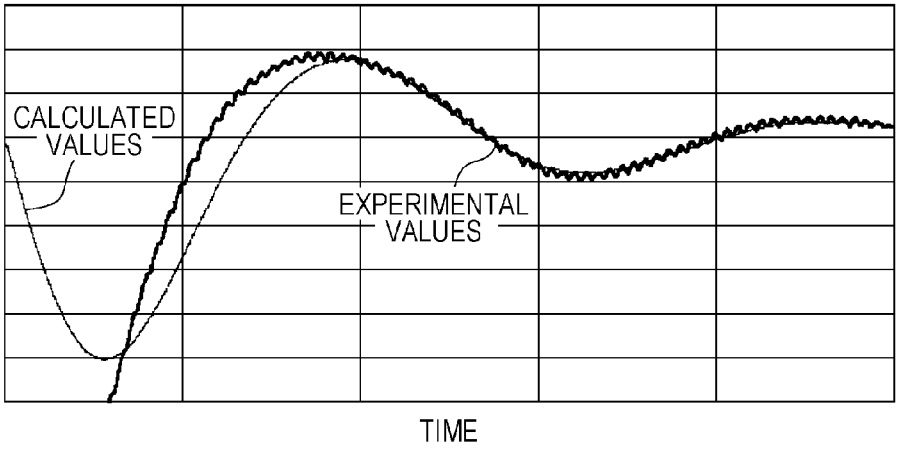
FIG. 8 is a graph which shows a relationship between experimental values and calculated values of the residual vibration of the diaphragm in FIG. 3 in a case of normal discharge.

The calculation result which is obtained from the formula will be compared with the experimental result in the experiment of the residual vibration of the diaphragm 243 after ink droplets are discharged which is performed separately. FIG. 8 is a graph which shows a relationship between experimental values and calculated values of the residual vibration of the diaphragm 243. The two waveforms of the experimental values and the calculated values are mostly matched as is clear from the graph shown in FIG. 8.

Now, regardless of whether a discharging operation as described above is performed in each of the ink jet heads 100 of the head unit 35, there are cases where a phenomenon where ink droplets are not normally discharged from the nozzle 241, that is, where discharge abnormalities are generated in the liquid droplets. As described later, examples of the causes which generate discharge abnormalities include (1) the introduction of bubbles to the inside of the cavity 245, (2) drying and thickening (fixing) of the ink in the vicinity of the nozzle 241, (3) paper dust attachment in the vicinity of the outlets of the nozzle 241, and the like.

When the discharge abnormalities are generated, liquid droplets are typically not discharged from the nozzle 241 as a result, that is, a phenomenon where liquid droplets are not discharged occurs, and dot omissions occur in the pixels in the image which is printed (drawn) onto the recording paper P in this case. In addition, in a case of the discharge abnormalities, even when liquid droplets are discharged from the nozzle 241, since the liquid droplets do not land properly due to the amount of the liquid droplets being excessively low or the flying direction (the trajectory) of the liquid droplets being shifted, the phenomenon where liquid droplets are not discharged occurs to cause the dot omissions in the pixels after all. As a result, there are cases where the discharge abnormalities in the liquid droplets are simply referred to as "dot omissions" in following description.

Below, at least one of the values of the acoustic resistance r and the inertance m is adjusted based on the comparison result shown in FIG. 8 such that the calculated values and the experimental values of the residual vibration of the diaphragm 243 are matched (mostly matched) according to each cause of a dot omission (discharge abnormality) phenomenon (the phenomenon where liquid droplets are not discharged) which occurs in the nozzle 241 of the ink jet head 100 during the printing process.

Figure 9:
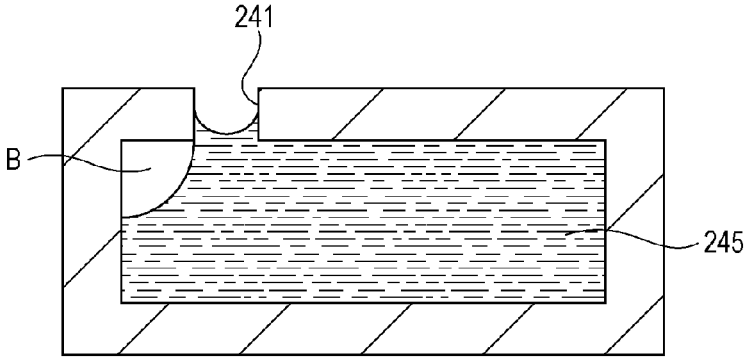
FIG. 9 is a conceptual diagram of the vicinity of nozzles in a case where bubbles are introduced inside the cavity in FIG. 3.

Firstly, the introduction of bubbles to the inside of the cavity 245 which is one of the causes of dot omission will be examined. FIG. 9 is a conceptual diagram of the vicinity of the nozzles 241 in a case where bubbles B are introduced inside the cavity 245 in FIG. 3. As shown in FIG. 9, the bubbles B which are generated are assumed to be generated and attached onto a wall surface of the cavity 245 (FIG. 9 shows a case where the bubbles B are attached in the vicinity of the nozzle 241 as an example of the attachment position of the bubbles B).

Thus, in a case where the bubbles B are introduced inside the cavity 245, it is considered that the total weight of the ink which fills the inside of the cavity 245 is reduced and that the inertance m is decreased. In addition, since the bubbles B are attached to the wall surface of the cavity 245, it is considered that the acoustic resistance r is decreased in a state where the diameter of the nozzle 241 is as large as the diameter of the bubble.

Figure 10:
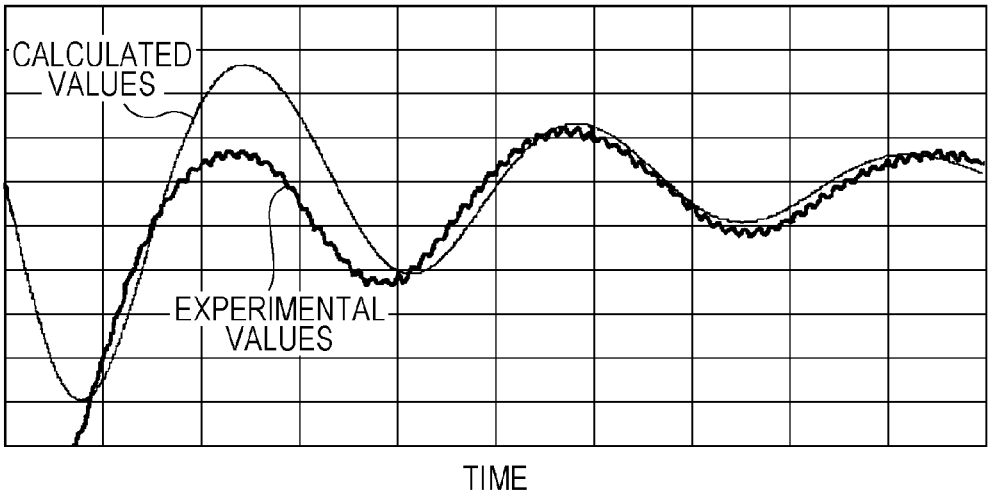
FIG. 10 is a graph which shows calculated values and experimental values of the residual vibration in a state where ink droplets are no longer discharged due to the introduction of bubbles into the cavity.

Accordingly, a result (graph) is obtained as in FIG. 10 by setting both the acoustic resistance r and the inertance m to be small and matching these with the experimental values of the residual vibration at the time of bubbles introduction with respect to the case in FIG. 8 where ink is normally discharged. In a case where the bubbles are introduced inside the cavity 245, a characteristic residual vibration waveform where the frequency is high compared to during normal discharging is obtained as is clear from the graphs shown in FIG. 8 and FIG. 10. Here, it is possible to confirm that the attenuation rate of the amplitude of the residual vibration is also low due to the decrease or the like in the acoustic resistance r and also that the residual vibration slowly decreases in amplitude.

Figure 11:
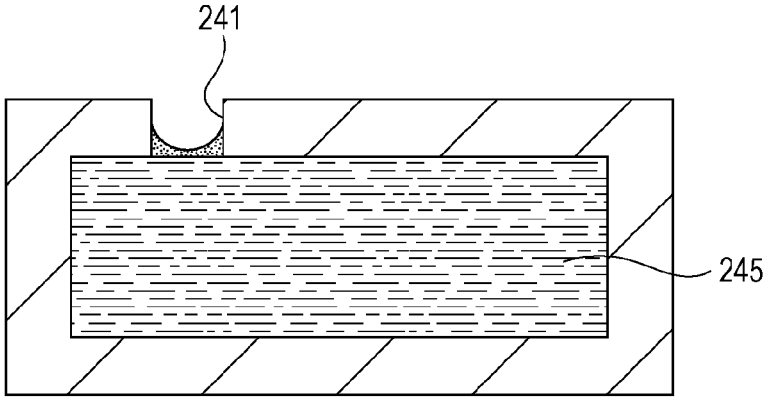
FIG. 11 is a conceptual diagram of the vicinity of nozzles in a case where the ink in the vicinity of the nozzles in FIG. 3 is fixed due to drying.

Next, drying (fixing and thickening) of the ink in the vicinity of the nozzle 241 which is another cause of dot omission will be examined. FIG. 11 is a conceptual diagram of the vicinity of nozzles 241 in a case where the ink in the vicinity of the nozzle 241 in FIG. 3 is fixed due to drying. As shown in FIG. 11, in a case where the ink in the vicinity of the nozzle 241 is dried and fixed, the ink inside the cavity 245 is in a state of being confined inside the cavity 245.

Thus, in a case where the ink in the vicinity of the nozzles 241 is dried and thickened, it is considered that the acoustic resistance r is increased.

Figure 12:
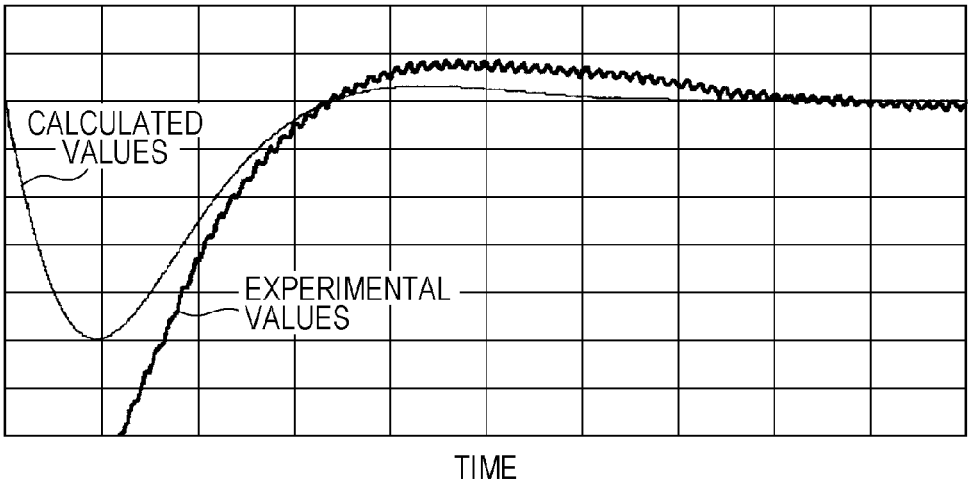
FIG. 12 is a graph which shows calculated values and experimental values of the residual vibration in a state where the ink in the vicinity of the nozzles is dried and thickened.

Accordingly, a result (graph) is obtained as in FIG. 12 by setting the acoustic resistance r to be large and matching this with the experimental values of the residual vibration at the time of the drying and fixing (thickening) of ink in the vicinity of the nozzle 241 with respect to the case in FIG. 8 where ink is normally discharged. Here, the experimental values shown in FIG. 12 were obtained by measuring the residual vibration of the diaphragm 243 in a state where it is not possible for ink to be discharged due to the ink in the vicinity of the nozzles 241 being dried and thickened (the ink is stuck) after the head unit 35 is left to stand for several days in a state where a cap which is not shown in the diagram is not mounted thereon. In a case where the ink in the vicinity of the nozzle 241 is fixed due to drying, a characteristic residual vibration waveform is obtained where the frequency is very low compared to during normal discharging and at the same time the residual vibration is excessively attenuated as is clear from the graphs shown in FIG. 8 and FIG. 12. This is because the diaphragm 243 rapidly becomes unable to vibrate (due to the excessive attenuation) since the ink inside the cavity 245 does not have an escape route when the diaphragm 243 moves upward in FIG. 3 after ink flows inside the cavity 245 from the reservoir 246 due to the diaphragm 243 being drawn downward in FIG. 3 in order to discharge the ink droplets.

Figure 13:
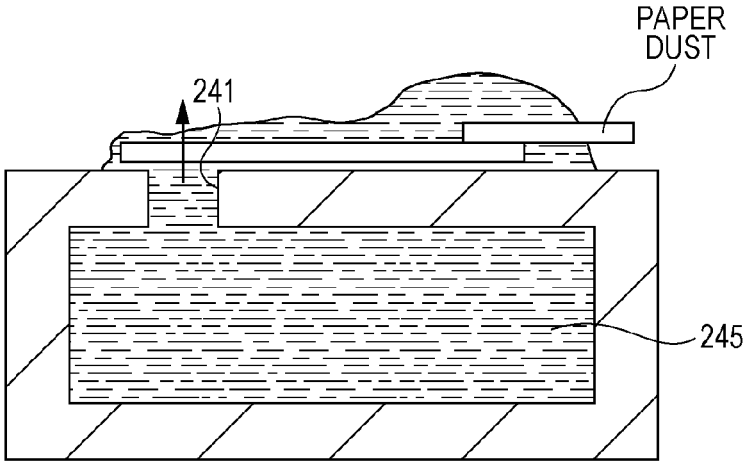
FIG. 13 is a conceptual diagram of the vicinity of nozzles in a case where paper dust is attached in the vicinity of nozzle outlets in FIG. 3.

Next, paper dust attachment in the vicinity of the outlet of the nozzle 241 which is another cause of dot omission will be examined. FIG. 13 is a conceptual diagram of the vicinity of the nozzle 241 in a case where paper dust is attached in the vicinity of the nozzle 241 outlet in FIG. 3. As shown in FIG. 13, in a case where paper dust is attached in the vicinity of the outlet of the nozzle 241, ink leaks out from inside the cavity 245 via the paper dust and it is not possible to discharge the ink from the nozzle 241. Thus, in a case where paper dust is attached in the vicinity of the outlet of the nozzle 241 and ink leaks out from the nozzle 241, it is considered that the inertance m is increased due to the amount of ink inside the cavity 245 which leaks out being increased more than is normal as seen from the diaphragm 243. In addition, it is considered that the acoustic resistance r is increased by fibers of the paper dust which is attached in the vicinity of the outlet of the nozzle 241.

Figure 14:
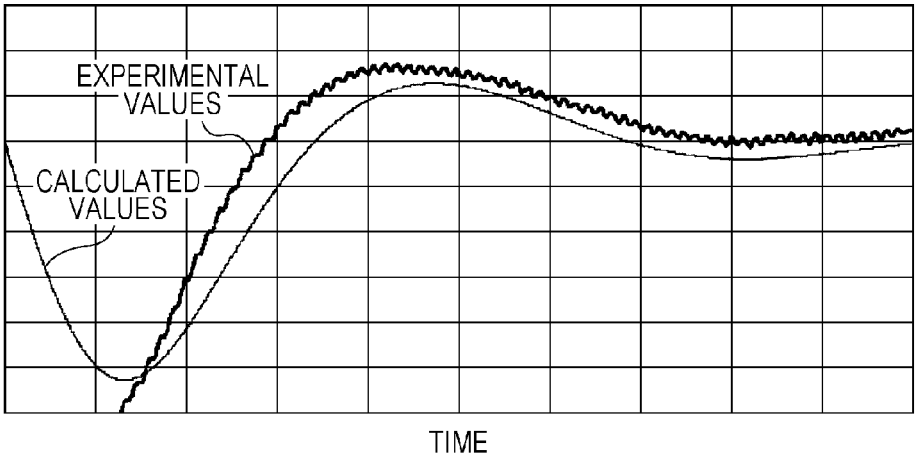
FIG. 14 is a graph which shows calculated values and experimental values of the residual vibration in a state where paper dust is attached to the nozzle outlets.
Figure 15A:
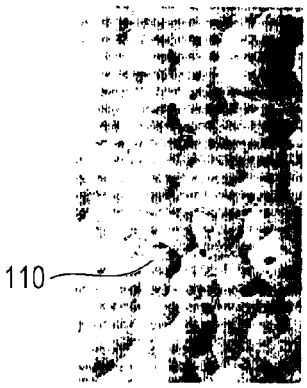
FIGS. 15A and 15B are photographs which show the state of the nozzles before and after the paper dust is attached in the vicinity of the nozzles.
Figure 15B:
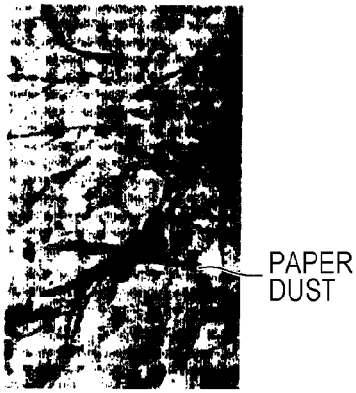

Accordingly, a result (graph) is obtained as in FIG. 14 by setting both the inertance m and the acoustic resistance r to be large and matching these with the experimental values of the residual vibration when the paper dust is attached in the vicinity of the outlets of the nozzles 241 with respect to the case in FIG. 8 where ink is normally discharged. In a case where paper dust is attached in the vicinity of the outlet of the nozzle 241, a characteristic residual vibration waveform is obtained where the frequency is low compared to during normal discharging as is clear from the graphs shown in FIG. 8 and FIG. 14 (here, the frequency of the residual vibration is higher in the case of paper dust attachment than in the case of dried ink as is also clear from the graphs shown in FIG. 12 and FIG. 14). Here, FIGS. 15A and 15B are photographs which show the state of the nozzle 241 before and after the paper dust is attached. From FIG. 15B, it is possible to see a state where ink leaks out along the paper dust when paper dust is attached in the vicinity of the outlet of the nozzle 241.

Here, in both a case where ink in the vicinity of the nozzle 241 is dried and thickened and a case where paper dust is attached in the vicinity of the outlet of the nozzle 241, the frequency of the attenuated vibration is low compared to a case where ink droplets are normally discharged. In order to identify these two causes of dot omission (non-discharging of ink and discharge abnormalities) from the waveform of the residual vibration of the diaphragm 243, for example, it is possible to carry out the identification by comparison using a predetermined threshold in a frequency, a cycle, or a phase of the attenuated vibration or from a cycle change of the residual vibration (attenuated vibration) or the attenuation rate of the amplitude change. Thus, it is possible to detect discharge abnormalities of each of the ink jet heads 100 according to changes in the residual vibration of the diaphragm 243 when ink droplets are discharged from the nozzle 241 in each of the ink jet heads 100, in particular, changes in the frequency thereof. In addition, it is possible to identify the causes of the discharge abnormalities by comparing the frequency of the residual vibration in such a case with the frequency of the residual vibration during normal discharging.

The ink jet printer 1 according to the present embodiment detects discharge abnormalities by analyzing the residual vibration.

Figure 16:
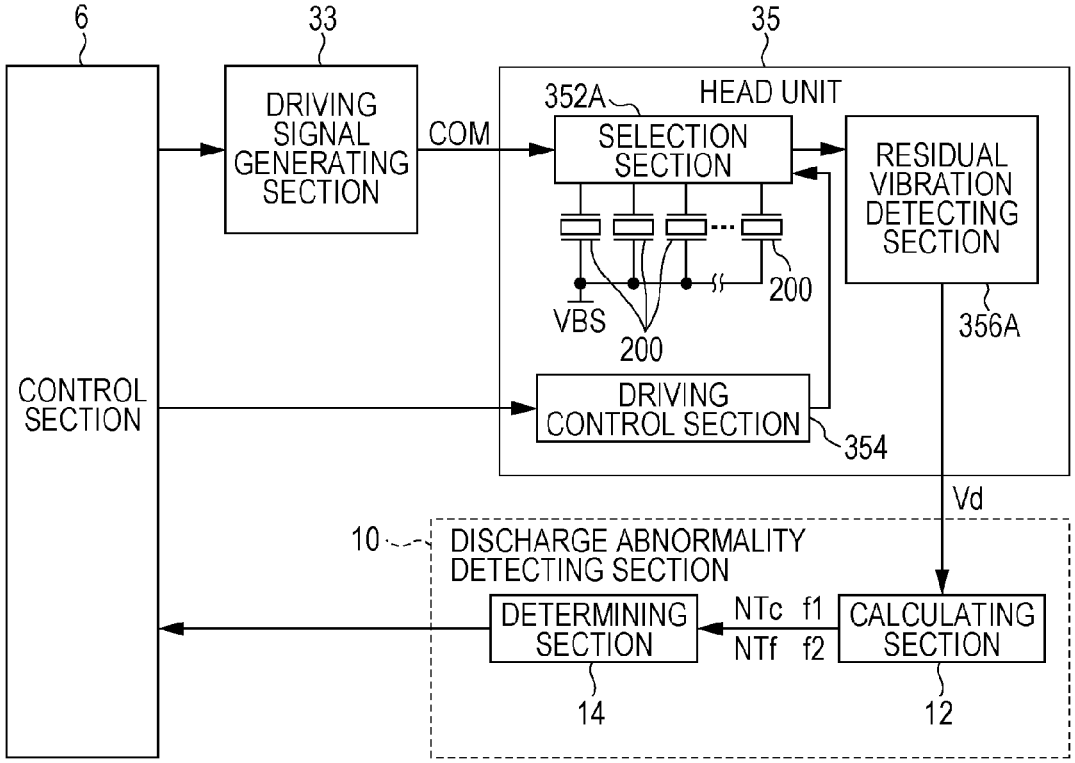
FIG. 16 is a block diagram which shows main sections of an ink jet printer which relate to detecting discharge abnormalities.

FIG. 16 is a block diagram which shows main sections of the ink jet printer 1 which relate to the detecting of discharge abnormalities. As shown in the same diagram, the head unit 35 has a plurality of the piezoelectric elements 200, a selection section 352A, a driving control section 354, and a residual vibration detecting section 356A. The driving control section 354 generates a control signal based on print data, a clock signal, or the like which is supplied from the control section 6 and supplies the control signal to the selection section 352A.

As described above, in the present embodiment, a driving signal COM for testing is applied to the piezoelectric element 200 during a print operation and the residual vibration which is a pressure change inside the cavity which is generated as a result is detected in the residual vibration detecting section 356A as a change in the electromotive force of the piezoelectric element 200. The selection section 352A supplies the driving signal COM for testing to the piezoelectric element 200 based on the control signal on one hand and supplies the electromotive force of the piezoelectric element 200 to the residual vibration detecting section 356A at the time of the detecting of the residual vibration on the other.

Since it is necessary for the driving signal COM to drive the piezoelectric element 200, the driving signal COM is operated, for example, at a power voltage of 42 V. With respect to this, the residual vibration detecting section 356A or the discharge abnormality detecting section 10 is operated, for example, at a power voltage of 3.3 V.

The residual vibration detecting section 356A generates a detecting signal Vd which indicates changes in the electromotive force of the piezoelectric element 200 and supplies the detecting signal Vd to the discharge abnormality detecting section 10. The discharge abnormality detecting section 10 is provided with the measuring section 12 and the determining section 14. The measuring section 12 generates phase data NTf which indicates the phase of the residual vibration, an NTf flag f1 which indicates that the phase data NTf is valid, cycle data NTc which indicates the cycle of the residual vibration, and an NTc flag f2 which indicates that the cycle data NTc is valid (refer to FIG. 24). The determining section 14 determines the discharging state of ink droplets in each of the nozzles 241 based on the phase data NTf, the NTf flag f1, the cycle data NTc, and the NTc flag f2 and transmits the determination result to the control section 6.

Figure 17:
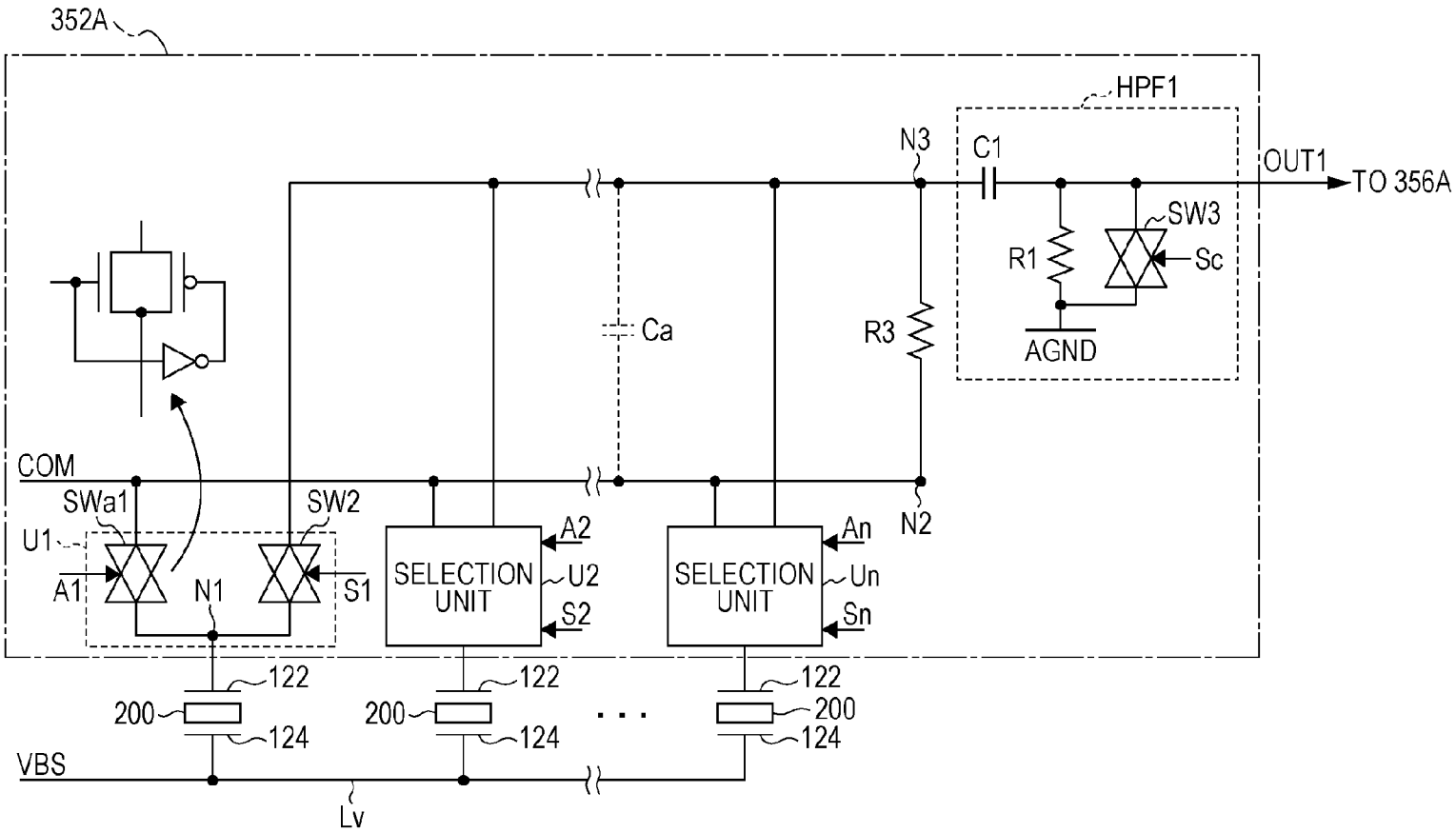
FIG. 17 is a circuit diagram which shows an electrical configuration of a selection section and a plurality of piezoelectric elements according to a first embodiment.

FIG. 17 is a circuit diagram which shows an electrical configuration of the selection section 352A and a plurality of the piezoelectric elements 200. In this example, one head unit 35 is provided with n (n is a natural number of two or more) piezoelectric elements 200. A first electrode 122 in each of the n piezoelectric elements 200 corresponds to the external electrode 248 and the inner electrode 249 on the upper side shown in FIG. 3 and is connected with selection units U1 to Un. A second electrode 124 in the n piezoelectric elements 120 corresponds to the external electrode 248 and the inner electrode 249 on the lower side shown in FIG. 3 and a fixed potential VBS is supplied thereto. The second electrode 124 functions as a supply line Lv which supplies the fixed potential VBS.

The selection unit U1 is provided with a first switch SWa1 and a second switch SW2. These switches SWa1 and SW2 are configured by transfer gates. The transfer gates in this example are provided with a P channel transistor and an N channel transistor which are connected in parallel as shown in the same diagram; however, these may be configured by one channel transistor.

The first switch SWa1 is in the on-state when a control signal A1 is a high level and applies the driving signal COM to the piezoelectric elements 200, and is in the off-state when the control signal A1 is a low level and does not apply the driving signal COM to the piezoelectric elements 200. That is, the first switch SWa1 is arranged so as to be able to switch whether or not the driving signal COM is applied to the piezoelectric elements 200.

On the other hand, the second switch SW2 is in the on-state when a control signal S1 is a high level and supplies the electromotive force of the piezoelectric elements 200 to the residual vibration detecting section 356A via a first high-pass filter HPF1, and is in the off-state when the control signal S1 is a low level and does not supply the electromotive force of the piezoelectric elements 200 to the residual vibration detecting section 356A. That is, the second switch SW2 is arranged so as to be able to switch whether or not changes in the electromotive force of the piezoelectric elements 200 are applied to the residual vibration detecting section 356A.

Here, in the present embodiment, the period when the first switch SWa1 is in the on-state and the period when the second switch SW2 is in the on-state partially overlap without the first switch SWa1 and the second switch SW2 being exclusively in the on-state. Details description will be given of the operation below.

In addition, the piezoelectric elements 200, the first switch SWa1, and the second switch SW2 are electrically connected in a first node N1. In addition, the driving signal generating section 33 and the first switch SWa1 are electrically connected in a second node N2. Furthermore, the second switch SW2 and the first high-pass filter HPF1 are electrically connected in a third node N3.

In addition, a third resistor R3 is provided between the second node N2 and the third node N3. The third resistor R3 functions as a bias resistor which supplies the voltage of the driving signal COM to the third node N3.

The first high-pass filter HPF1 is provided with a first capacitor C1, a first resistor R1, and a third switch SW3 which is provided in parallel with the first resistor R1, and outputs a first output signal OUT1 to the residual vibration detecting section 356A. One of the terminals of the first capacitor C1 is connected with the third node N3 and the other terminal is connected with one of the terminals of the first resistor R1. An analog ground AGND, which is a fixed potential, is supplied to the other terminal of the first resistor R1. The potential of the analog ground AGND is set, for example, to a central potential between a high power potential and a low power potential of the residual vibration detecting section 356A which will be described later.

The third switch SW3 is configured by a P channel transistor and an N channel transistor being connected in parallel in the same manner as the first switch SWa1. The third switch SW3 is in the on-state when a control signal Sc is a high level and is in the off-state when the control signal Sc is a low level. It is possible to clamp the potential of the input terminal of the residual vibration detecting section 356A using the analog ground AGND by the third switch SW3 being in the on-state.

Here, with respect to the maximum potential of the driving signal COM in the present embodiment being 42 V, the high power potential of the residual vibration detecting section 356A which will be described later is 3.3 V and the low power potential is 0 V. This is because, while a driving signal COM with a high amplitude is necessary in order to drive the piezoelectric elements 200, the residual vibration detecting section 356A is a processing circuit for an analog signal and a large dynamic range is not necessary.

Changes in the electromotive pressure of the piezoelectric elements 200 reflect the changes in the pressure inside the cavities. Due to this, the frequency band of the residual vibration is narrow compared to the frequency band of the driving signal COM. On the other hand, there are times when noise is superimposed on the signal path of the residual vibration. The high-pass filter HPF1 attenuates frequency components which are in a lower frequency range than the frequency band of the residual vibration. Due to this, it is possible to improve the precision with which the residual vibration is detected in the residual vibration detecting section 356A.

In addition, the direct current component of the first high-pass filter HPF1 is cut by the first capacitor C1. Since the high power potential of the residual vibration detecting section 356A is low compared to the maximum potential of the driving signal COM as described above, it is not suitable for direct current coupling. In the present embodiment, it is possible to operate the residual vibration detecting section 356A normally in the latter stage by cutting the direct current component with the first high-pass filter HPF1.

In addition, the third switch SW3 is in the on-state except for the period when the residual vibration is detected and the input terminal of the residual vibration detecting section 356A is clamped by the analog ground AGND. That is, the third switch SW3 is in the on stage during the period when the potential of the third node N3 changes greatly. Even when the direct current component is cut by the first capacitor C1, when the potential of the third node N3 changes greatly, the potential of the input terminal of the residual vibration detecting section 356A changes greatly to exceed the high power potential. There are times it takes a long time until an electrical charge is charged in each of the sections of circuit components and the operation is normally carried out when a signal such as this with a high amplitude which exceeds the dynamic range is supplied in an electronic circuit. In addition, it is necessary to increase the withstand voltage of parts such as a transistor which configures an electronic circuit. However, since the potential of the input terminal of the residual vibration detecting section 356A is clamped by the analog ground AGND in the present embodiment in a state where the third switch SW3 is in the on-state during the period when the potential of the third node N3 changes greatly, it is possible to immediately start the detecting of the residual vibration during the detecting period and it is further possible to reduce the withstand voltage of the parts which configure the residual vibration detecting section 356A.

In the selection section 352A described above, the selection units U2 to Un are configured in the same manner as the selection unit U1. In addition, control signals A1 to An and S1 to Sn which are supplied to each of the selection units U1 to Un and the control signal Sc which is supplied to the third switch SW3 are generated in the driving control section 354 shown in FIG. 16.

Figure 18:
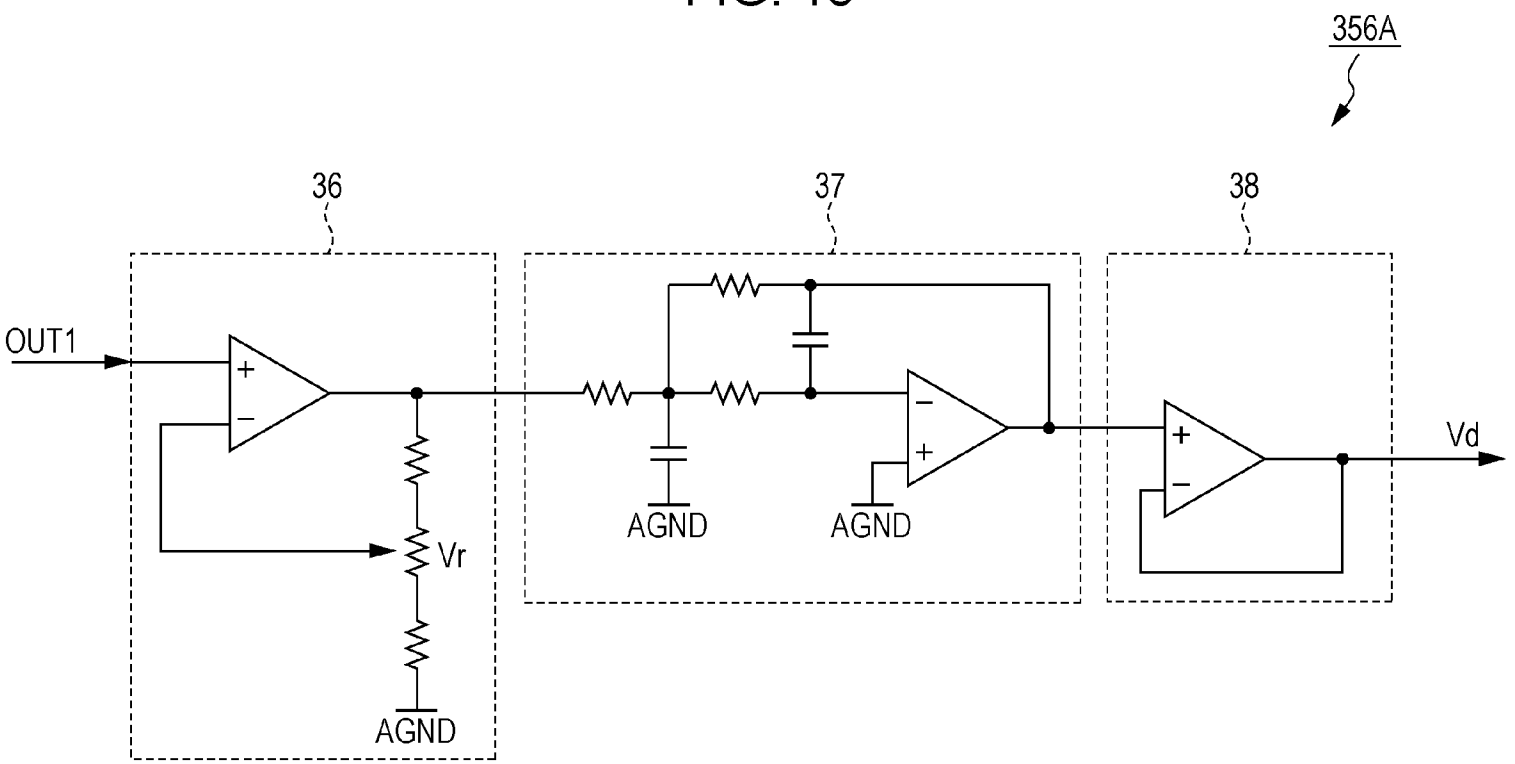
FIG. 18 is a circuit diagram which shows a configuration of a residual vibration detecting section according to the first embodiment.

A detailed configuration example of the residual vibration detecting section 356A is shown in FIG. 18. The residual vibration detecting section 356A is provided with a gain adjusting section 36, a low pass filter 37, and a buffer 38. The gain adjusting section 36 is a negative feedback type amplifier which uses an operational amplifier and it is possible to adjust the amplitude of the first output signal OUT1 by adjusting the mid-point of an adjustable resistor Vr which divides the voltage of an output signal therefrom.

The low pass filter 37 attenuates a high frequency component of the first output signal OUT1. The low pass filter 37 in this example is a multi-feedback type which uses an operational amplifier, but the low pass filter 37 may be any type as long as the high frequency components are more attenuated than the frequency band of the residual vibration. It is possible to remove a noise component by limiting the detecting frequency range by the low pass filter 37.

The buffer 38 outputs a detection signal Vd with a low impedance by converting the impedance. The buffer 38 in this example is configured with a voltage follower which uses an operational amplifier.

Figure 19:
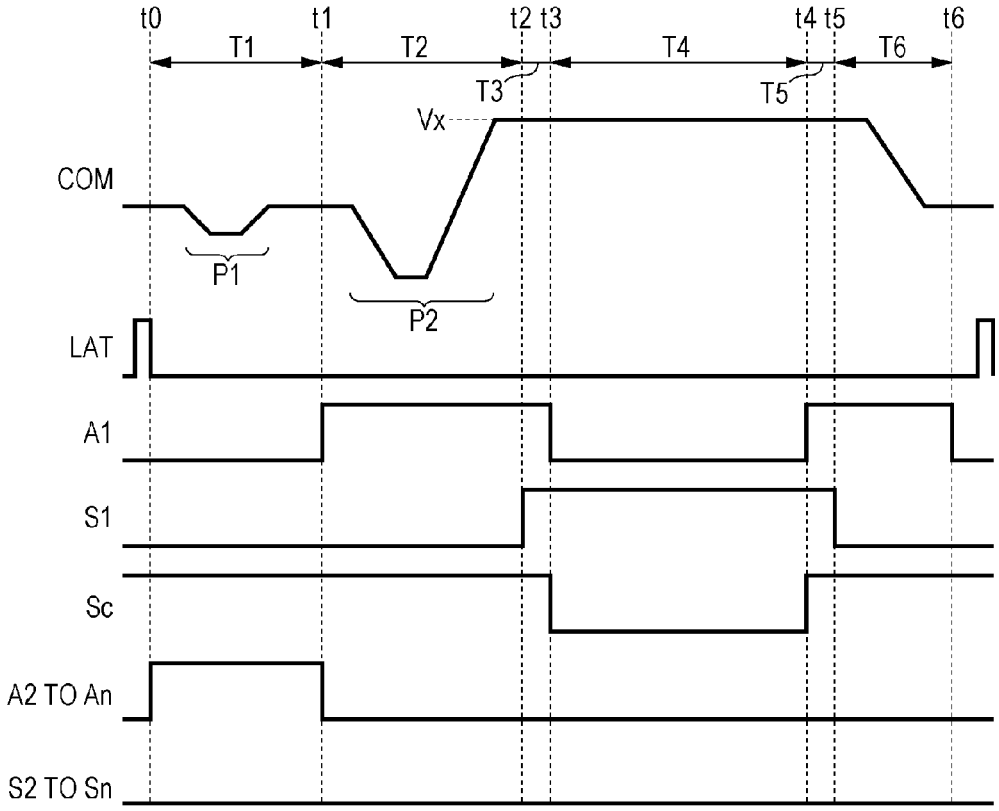
FIG. 19 is a timing chart which shows an operation of the selection section.

Next, description will be given of operation of the selection section 352A. FIG. 19 is a timing chart which shows an operation of the selection section 352A and FIG. 20A to FIG. 22 are explanatory diagrams which show the on-state and the off-state of the switches during each of the periods. Here, in this example, the discharge state of ink droplets is detected for the nozzles 241 which correspond to the selection unit U1.

Figure 20A:
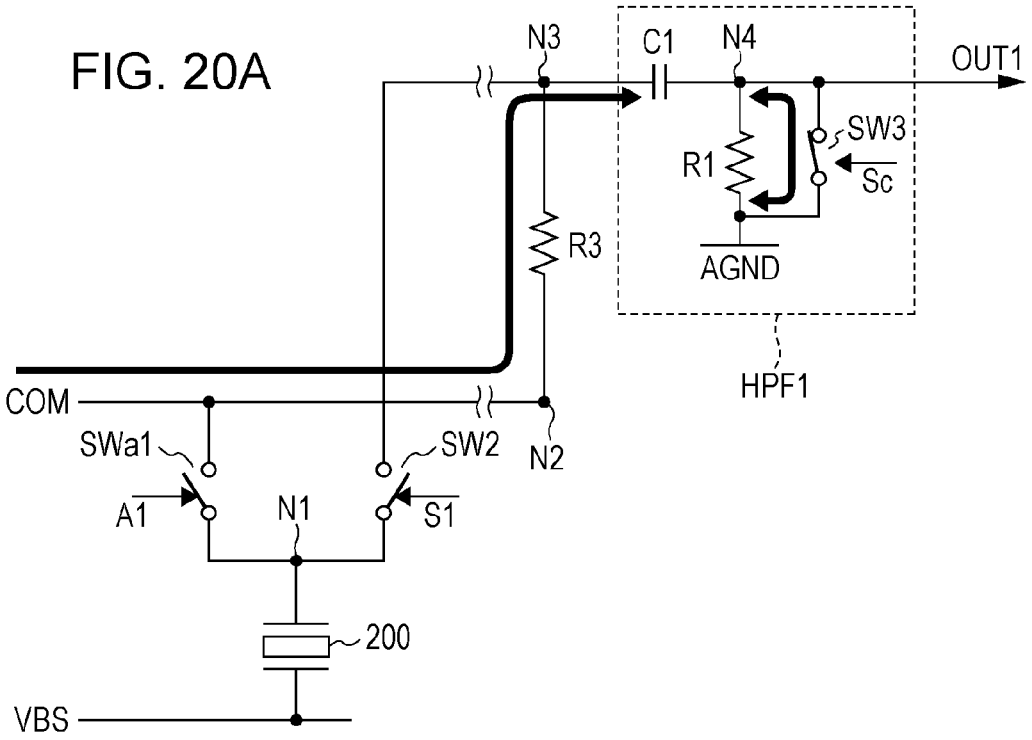
FIGS. 20A and 20B are explanatory diagrams which show switching between an on-state and an off-state of the selection section in periods T1, T2, and T6.

Firstly, a micro-vibration pulse P1 is included in the driving signal COM during a first period T1 from a time t0 to a time t1. When the micro-vibration pulse P1 is applied to the piezoelectric elements 120, the piezoelectric elements 120 micro-vibrate. In this case, ink droplets are not discharged from the nozzles; however, it is possible to suppress the thickening of the ink by stirring the ink inside the cavity. Since the control signal Sc is a high level during the first period T1, the third switch SW3 is in the on-state. On the other hand, since the control signals A1 and S1 are low level during the first period T1, the first switch SWa1 and the second switch SW2 are in the off-state. As a result, since the third switch SW3 is in the on-state as shown in FIG. 20A, the potential of a fourth node N4 is clamped by the analog ground AGND.

Here, since control signals A2 to An are high level and control signals S2 to Sn are low level, the thickening is suppressed for the ink inside the cavity which corresponds to the nozzles 110 which are not the target of inspection by the micro-vibration pulse P1 being applied to the piezoelectric elements 120 which correspond to the nozzles 241 which are not the target of inspection.

Figure 20B:
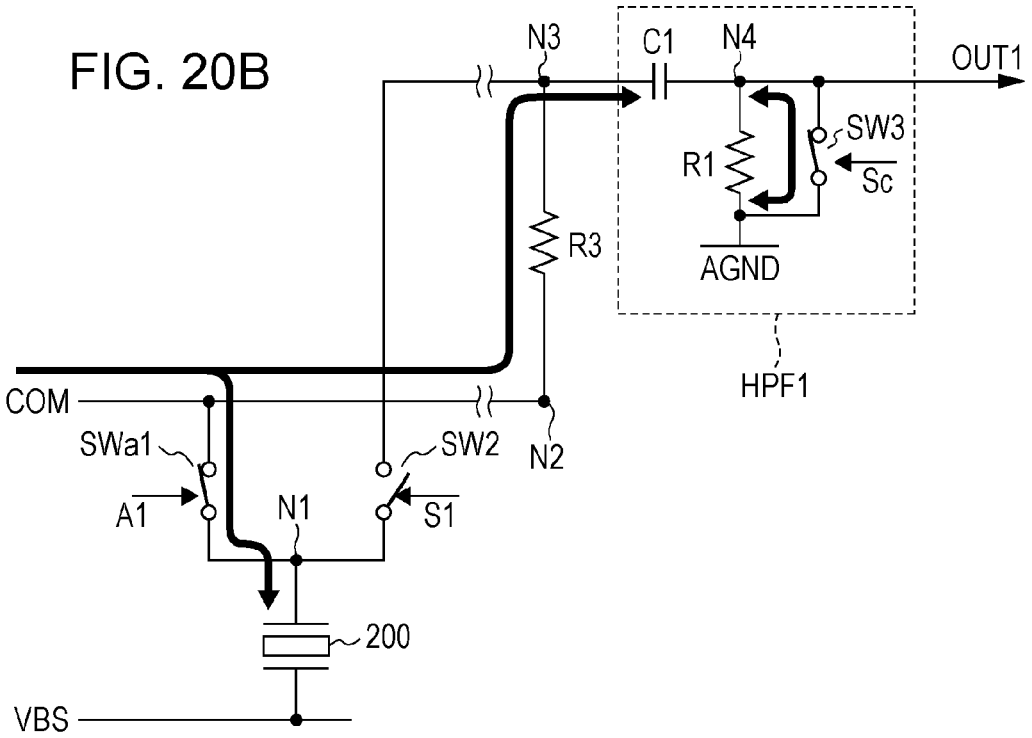

Next, an inspection pulse P2 is included in the driving signal COM in a second period T2 from a time t1 to a time t2. The control signal A1 is a high level in the second period T2 in the same manner as the first period T1 except for the point that the first switch SWa1 is in the on-state. Therefore, the states of the first to the third switches SWa1, SW2, and SW3 are as shown in FIG. 20B.

When the inspection pulse P2 is applied to the piezoelectric elements 200 by the first switch SWa1 being in the on-state, the piezoelectric elements 200 warp in a direction in which ink droplets are drawn inside the cavities in synchronization with the falling of the inspection pulse P2 and warp in a direction in which ink droplets are pushed out from the cavities in synchronization with the rising of the inspection pulse P2.

Here, the amplitude, the phase, and the rising time in the inspection pulse P2 may be adjusted such that the ink droplets are not discharged from the nozzle 241 or the ink droplets may be discharged from the nozzle 241 according to the inspection pulse P2. It is possible to detect the residual vibration during normal printing in a case where the inspection pulse P2 is a waveform which corresponds to non-discharging. On the other hand, ink droplets may be discharged by moving the head unit 35 to the position which is shifted from the recording paper in a case where the inspection pulse P2 is a waveform which corresponds to discharging.

Figure 21:
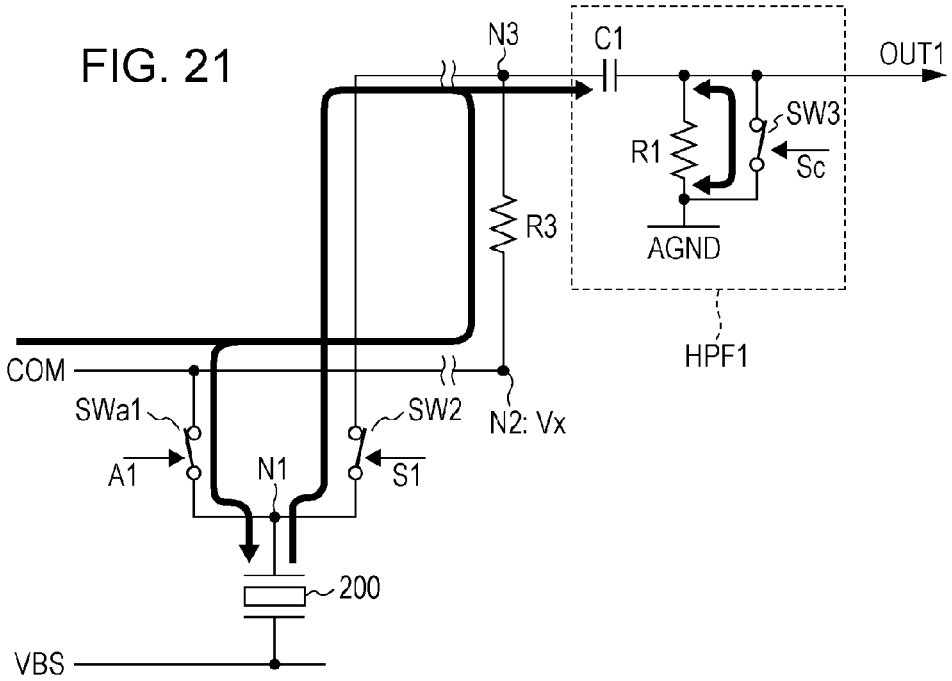
FIG. 21 is an explanatory diagram which shows switching between an on-state and an off-state in the selection section in periods T3 and T5.

Next, the driving signal COM is a predetermined potential Vx in a third period T3 from the time t2 to a time t3. Since the control signals A1, S1, and Sc are high level in the third period T3, the first switch SWa1, the second switch SW2, and the third switch SW3 are in the on-state. As a result, the potential of the second node N2 is the predetermined potential Vx as shown in FIG. 21 and the potential of the third node N3 is also the predetermined potential Vx.

Figure 22:
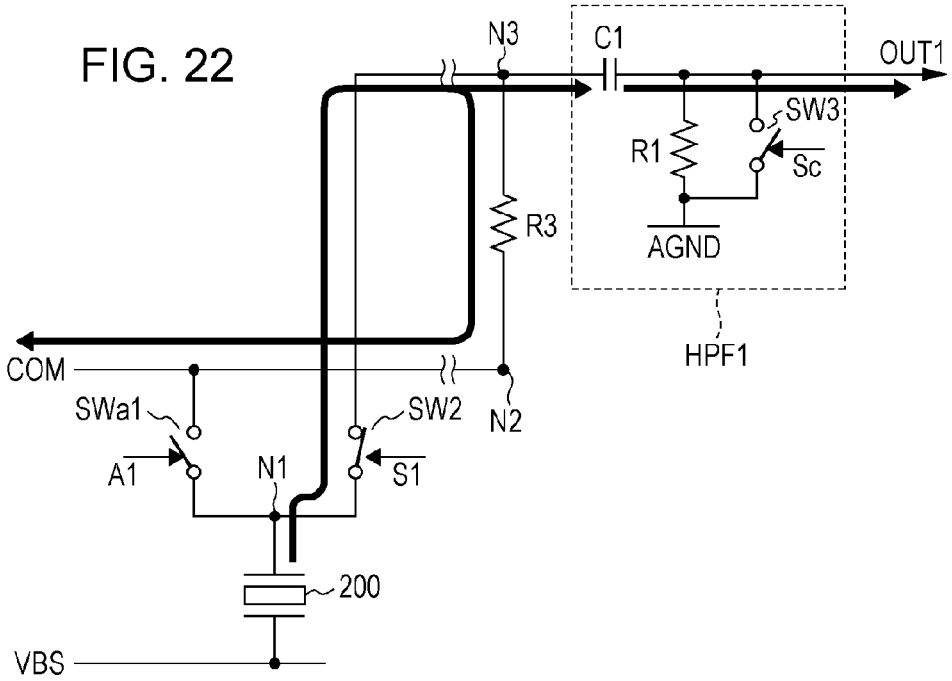
FIG. 22 is an explanatory diagram which shows switching between an on-state and an off-state of the selection section in period T4.

Next, the driving signal COM is the predetermined potential Vx in a fourth period T4 from the time t3 to a time t4. Since the control signal S1 is maintained at a high level in the fourth period T4, the second switch SW2 is in the on-state. On the other hand, since the control signals A1 and Sc are low level, the first switch SWa1 and the third switch SW3 are in the off-state. As a result, the potential of the second node N2 is the predetermined potential Vx as shown in FIG. 22 and, in addition, the electromotive force which is generated in the piezoelectric elements 200 is extracted as the first output signal OUT1 via the first high-pass filter HPF1 in a state where the potential of the third node N3 is biased by the third resistor R3.

Next, the driving signal COM is the predetermined potential Vx in a fifth period T5 from the time t4 to a time t5. Since the control signals A1, S1, and Sc are high level during the fifth period T5 in the same manner as the third period T3, the first switch SWa1, the second switch SW2, and the third switch SW3 are in the on-state. As a result, the potential of the second node N2 is the predetermined potential Vx as shown in FIG. 21 and, in addition, the potential of the third node N3 is also the predetermined potential Vx.

Next, since the control signals A1 and Sc are high level during a sixth period T6 from the time t5 to a time t6 in the same manner as the second period T2, the first switch SWa1 and the third switch SW3 are in the on-state. On the other hand, since the control signal S1 is low level, the second switch SW2 is in the off-state. As a result, the driving signal COM is applied to the piezoelectric elements 200 via the first switch SWa1 as shown in FIG. 20B. In addition, since the third switch SW3 is in the on-state, the potential of the fourth node N4 is clamped by the analog ground AGND.

Here, when a first state is a state where the first switch SWa1 is in the on-state and the second switch SW2 is in the off-state, a second state is a state where the first switch SWa1 is in the on-state and the second switch SW2 is in the on-state, and the third state is a state where the first switch SWa1 is in the off-state and the second switch SW2 is in the on-state, the driving control section 354 controls the first switch SWa1 and the second switch SW2 in order of the first state (the second period T2), the second state (the third period T3), and the third state (the fourth period T4). In addition, the driving control section 354 controls the first switch SWa1 and the second switch SW2 in order of the third state (the fourth period T4), the second state (the fifth period T5), and the first state (the sixth period T6).

In this manner, the second state is set while transitioning from the first state to the third state and while transitioning from the third state to the first state in order that switching noise is not generated by the potential of the third node N3 changing at the point in time when the on-state of the first switch SWa1 and the on-state of the second switch SW2 are switched.

That is, in the second state, the predetermined potential Vx of the driving signal COM is supplied to the third node N3 along a path of the first switch SWa1, the first node N1, and the second switch SW2, and the predetermined potential Vx of the driving signal COM is supplied along a path from the second node N2 to the third resistor R3.

The first switch SWa1 transitions to the off-state when this second state transitions to the third state; however, the path from the second node N2 to the third resistor R3 remains and the predetermined potential Vx of the driving signal COM is biased to the third node N3 by the third resistor R3. Thus, since the potential of the third node N3 does not change greatly when the state transitions from the first state to the third state, it is possible to reduce the switching noise. In addition, since it is possible for the current to continuously flow from the piezoelectric elements 200 by controlling the first switch SWa1 and the second switch SW2 in a sequence such as the first state, the second state, and the third state, it is possible to eliminate the generation of a surge voltage at the time of switching such as a counter electromotive force of a coil. As a result, it is possible to perform detecting of the residual vibration at the same time as when the fourth period T4 is started.

In addition, the second switch SW2 transitions to the off-state when the second state transitions to the first state; however, since the driving signal COM is applied to the piezoelectric elements 200 via the first switch SWa1 even in the second state and the potential of the second node N2 is the predetermined potential Vx of the driving signal COM, it is possible to reduce noise which is superimposed on the applied voltage of the piezoelectric elements 200.

In addition, since the third switch SW3 is in the on-state in the first state (the second period and the sixth period) and the second state (the third period and the fifth period), the potential of the fourth node N4 is clamped by the analog ground AGND. As shown in FIG. 17, there is a parasitic capacitance Ca between a supply line to which the driving signal COM is supplied and a supply line with which the third node N3 is connected and to which the electromotive force based on the residual vibration is supplied. Due to this, even when the second switch SW2 is in the off-state in the second period T2 shown in FIG. 19, the inspection pulse P2 with a high amplitude is transferred to the third node N3 via the parasitic capacitance Ca. According to the present embodiment, the third switch SW3 is in the on-state in the second period T2 and the third period T3 and the fourth node N4 is clamped by the analog ground AGND. Thus, it is possible to prevent the inspection pulse P2 from interfering with the residual vibration detecting section 356A.

Figure 23:
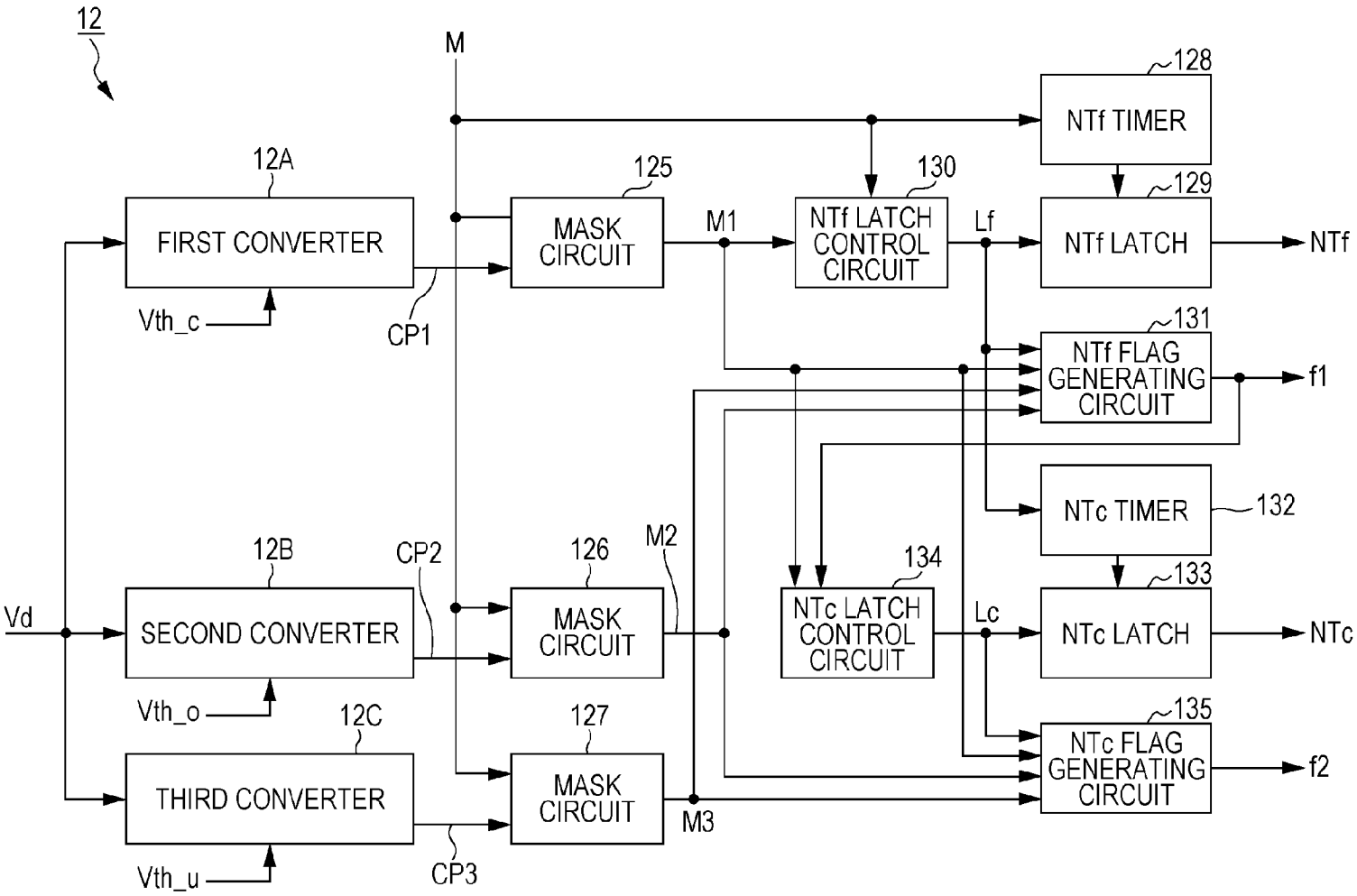
FIG. 23 is a block diagram which shows a configuration of a measuring section.
Figure 24:
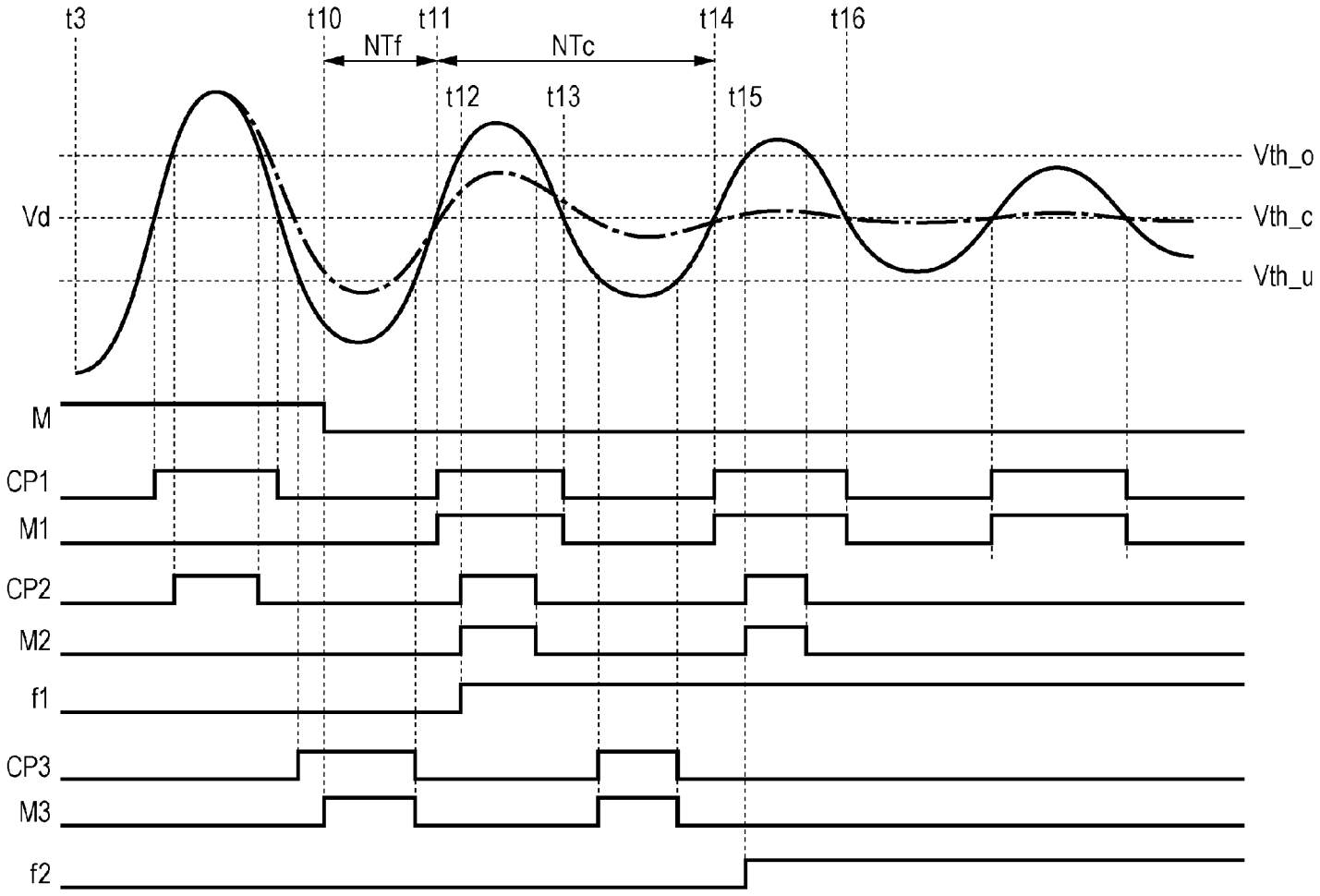
FIG. 24 is a timing chart which shows an operation of the measuring section.

Next, description will be given of the measuring section 12. FIG. 23 shows a configuration of the measuring section 12 and FIG. 24 shows a timing chart thereof. Based on the detection signal Vd which is generated in the residual vibration detecting section 356A, the measuring section 12 generates the phase data NTf which indicates a time which is related to the phase of the residual vibration, the cycle data NTc which indicates the time of one cycle of the residual vibration, the NTf flag f1 which indicates whether the phase data NTf is valid or invalid, and the NTc flag f2 which indicates whether the cycle data NTc is valid or invalid.

The measuring section 12 is provided with first to third comparators 12A to 12C and mask circuits 125 to 127. The first comparator 12A is a high level in a case where the detection signal Vd is threshold voltage Vth_c or higher when comparing the detection signal Vd with the threshold voltage Vth_c and outputs a comparing signal CP1 which is a low level in a case where the detection signal Vd is less than the threshold voltage Vth_c. The second comparator 12B is a high level in a case where the detection signal Vd is a threshold voltage Vth_o or higher when comparing the detection signal Vd with the threshold voltage Vth_o and outputs a comparing signal CP2 which is a low level in a case where the detection signal Vd is less than the threshold voltage Vth_c. The third comparator 12C is high level in a case where the detection signal Vd is less than the threshold voltage Vth_u when comparing the detection signal Vd with the threshold voltage Vth_u and outputs a comparing signal CP3 which is a low level in a case where the detection signal Vd is the threshold voltage Vth_u or more. Here, the threshold voltage Vth_c is determined such that the amplitude of the detection signal Vd is mid-level and has a relationship where Vth_o>Vth_c>Vth_u. The mask circuits 125 to 127 mask the comparing signals CP1 to CP3 in the high level period where a mask signal M is valid.

Here, in a case where the detection signal Vd initially exceeds the threshold voltage Vth_c after the mask signal M becomes invalid, the operation of the measuring section 12 has a normal edge detection mode where the detection signal Vd exceeds the threshold voltage Vth_c when the detection signal Vd is rising and a reverse edge detection mode where the detection signal Vd exceeds the threshold voltage Vth_c when the detection signal Vd is falling.

FIG. 24 shows an operation example of the normal edge detection mode. In this example, the residual vibration starts from the time t3. The time t3 is a timing when the control signal A1 shown in FIG. 19 transitions to the low level and the control signal Sc transitions to the low level and a timing when the first switch SWa1 transitions from the on-state to the off-state. In addition, t3 is a time at which the state where the residual vibration is electrically observable begins. In the example shown in FIG. 24, the detection signal Vd which shows the residual vibration is obtained from the time t3; however, in actual measurement, the operation is unstable directly after the start of the residual vibration and a detection signal Vd upon which noise is superimposed is often obtained.

Due to this, the comparing signals CP1 to CP3 are masked using the mask signal M. The phase data NTf described above indicates a time from when the mask signal M becomes invalid at a time t10 until the detection signal Vd initially becomes the threshold voltage Vth_c. Since the detection signal Vd shown in FIG. 24 is greater than the threshold voltage Vth_c at a time t11, the phase data NTf indicates a time from the time t10 to the time t11.

An NTf timer 128 shown in FIG. 23 starts the measuring of the time in synchronization with the falling edge of the mask signal M. Specifically, a clock signal (which is not shown in the diagram) is counted. The counting result of the NTf timer 128 is latched by an NTf latch 129. An NTf latch control circuit 130 generates a latch signal Lf in synchronization with the rising edge of a signal M1 where the detection signal Vd initially becomes the threshold voltage Vth_c after the mask signal M becomes invalid. The NTf latch 129 generates the phase data NTf by latching the counting result of the NTf timer 128 at the timing when the latch signal Lf becomes valid.

Here, when there is an abnormality in the discharging operation, for example, the detection signal Vd changes as shown by the dashed line in FIG. 24. Thus, in a case where the amplitude of the detection signal Vd is low, it is not possible to accurately measure the phase data NTf or the cycle data NTc. Thus, in the present embodiment, the NTf flag f1 and the NTc flag f2 described above are generated based on the amplitude of the detection signal Vd.

The NTf flag generating circuit 131 shown in FIG. 23 generates the NTf flag f1 based on the output signals M1 to M3 and the latch signal Lf of the mask circuits 125 to 127.

Specifically, in the normal edge detection mode, the NTf flag generating circuit 131 validates the NTf flag f1 in a case where the detection signal Vd is greater than the threshold voltage Vth_o during the period from when the detection signal Vd is initially greater than the threshold voltage Vth_c until the detection signal Vd is below the threshold voltage Vth_c after the mask signal M becomes invalid (for example, the example shown in FIG. 24). On the other hand, in the reverse edge detection mode, the NTf flag generating circuit 131 validates the NTf flag f1 in a case where the detection signal Vd is below the threshold voltage Vth_u during the period from when the detection signal Vd is initially below the threshold voltage Vth_c until the detection signal Vd is greater than the threshold voltage Vth_c after the mask signal M becomes invalid.

The example shown in FIG. 24 is after the mask signal M becomes invalid at the time t11 and the detection signal Vd is initially greater than the threshold voltage Vth_c. This is detected using the rising edge of the output signal M1. Then, the detection signal Vd is greater than the threshold voltage Vth_o until a time t13 when the falling edge of the output signal M1 is generated. This is detected according to the rising edge of an output signal M2 (a time t12). Thus, the NTf flag f1 is high level and valid from the time t12.

Next, an NTc timer 132 shown in FIG. 23 starts measuring the time when the latch signal Lf becomes valid. Specifically, a clock signal (which is not shown in the diagram) is counted. The counting result of the NTc timer 132 is latched by an NTc latch 133. The NTc latch control circuit 134 generates a latch signal Lc in synchronization with the rising edge of the signal M1 where the NTf flag f1 is valid and the detection signal Vd is the threshold voltage Vth_c for the second time. The NTc latch 133 generates the cycle data NTc by latching the counting result of the NTc timer 132 at the timing when the latch signal Lc becomes valid. In the example shown in FIG. 24, the second rising edge of the output signal M1 occurs at a time t14. Due to this, the cycle data NTc indicates the time from the time t11 to the time t14.

Next, the NTc flag generating circuit 135 shown in FIG. 23 generates the NTc flag f2 based on the output signals M1 to M3 and the latch signal Lc of the mask circuits 125 to 127.

Specifically, in the normal edge detection mode, the NTc flag generating circuit 135 validates the NTc flag f2 in a case where the detection signal Vd is greater than the threshold voltage Vth_o during the period from the rising edge of the signal M1 where the detection signal Vd is the threshold voltage Vth_c for the second time to the next falling edge after the latch signal Lc becomes valid. On the other hand, in the reverse edge detection mode, the NTc flag generating circuit 135 validates the NTc flag f2 in a case where the detection signal Vd is below the threshold voltage Vth_u during the period from the falling edge of the signal M1 where the detection signal Vd is the threshold voltage Vth_c for the second time to the next rising edge after the latch signal Lc becomes valid.

In the example of the normal edge detection mode shown in FIG. 24, the second rising edge of the output signal M1 is generated at the time t14 and the next falling edge is generated at a time t16. The detection signal Vd is greater than the threshold Vth_o and the rising edge of the output signal M2 is generated at a time t15 during the period from the time t14 to the time t16. Due to this, the NTc flag f2 becomes valid from the time t15.

Thus, in the present embodiment, even when the detection signal Vd is greater than (or below) the threshold voltage Vth_c, the NTc flag is determined to be valid in a case where the detection signal Vd is greater than the threshold voltage Vth_o (the threshold Vth_u) until the detection signal Vd is below (or greater than) the threshold voltage Vth_c without immediately being determined to be valid. Due to this, it is possible to determine a case where there is a discharge abnormality and the amplitude of the detection signal Vd is not sufficient in the determining section 14 at the latter stage.

Figures 25, 26:
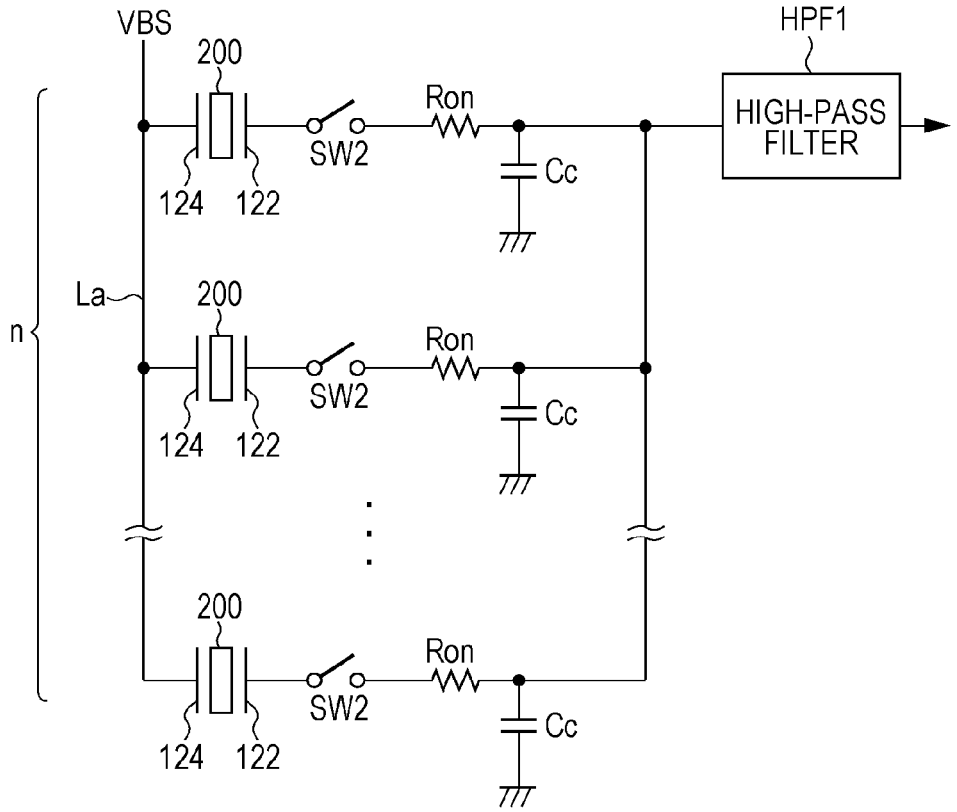
FIG. 25 is an explanatory diagram which shows the relationship between a determination result of a determining section and phase data NTf, cycle data NTc, an NTf flag, and an NTc flag.
FIG. 26 is a circuit diagram which shows an equivalent circuit of the selection section and the piezoelectric elements which are focused on the detecting of the residual vibration.

Next, the determining section 14 determines a discharge state as shown in FIG. 25 based on the phase data Ntf, the cycle data NTc, the NTf flag f1, and the NTc flag f2.

Firstly, when the range from a time Ta1 to a time Ta2 is normal, the cycle data NTc is determined as short in a case where Ta1>NTc, as normal in a case where Ta2≥NTc≥Ta1, and as long in a case where NTc>Ta2.

In addition, when the range from a time Tb1 to a time Tb2 is normal, the cycle data NTf is determined as long and short in a case where Tb1>NTf or NTf>Tb2 and as normal in a case where Tb2≥NTf≥Tb1.

In a case where the NTc flag f2 and the NTf flag f1 are both valid, the discharge state is determined based on the determination result of the phase data NTf and the cycle data NTc.

Specifically, in a case where the cycle data NTc is short, it is determined that there are bubbles inside the cavity (state number 0 or 1) regardless of the determination result of the phase data NTf. This is because it is considered to mean that the frequency of the residual vibration is high and that the bubbles are introduced inside the cavity 245 of the ink jet head 100 as described above.

In a case where the cycle data NTc and the phase data NTf are normal, it is determined that the discharge state is normal (state number 2). In a case where the cycle data NTc is normal and the phase data NTf is long and short, it is determined that there are bubbles inside the cavity (state number 3).

On the other hand, in a case where the cycle data NTc is long, it is determined that ink is thickened (state number 4 or 5) regardless of the determination result of the phase data NTf. This is because it is considered that the residual vibration is excessively attenuated and that the ink in the vicinity of the nozzle 241 is thickened due to drying (drying).

Furthermore, assuming a determination threshold Ta3, it may be determined that the ink is thickened in a case where NTc≥Ta3 and it may be determined that paper dust is attached (paper dust attachment) in the vicinity of the outlet of the nozzle 241 in a case where Ta3>NTc>Ta2.

Next, in a case where the NTc flag f2 is invalid and the NTf flag f1 is valid, ink omission is determined (state number 6 or 7). Furthermore, in a case where the NTc flag f2 and the NTf flag f1 are invalid, ink omission is determined (state number 8). Ink omission has the meaning of a state where it is not possible to discharge ink due to the ink not being input, or the like.

Thus, in the present embodiment, the determining section 14 determines the discharge state based on not only the phase data NTf or the cycle data NTc, but also the NTf flag f1 and the NTc flag f2 where the validity or invalidity thereof is indicated. That is, even when so called zero cross is detected due to the detection signal Vd exceeding the threshold voltage Vth_c, the zero cross detection is not immediately set to be valid and the zero cross detection which was generated in the past is set to be valid in a case where the detection signal Vd is subsequently monitored and changes so as to exceed the threshold voltage Vth_o or the threshold voltage Vth_u. Due to this, it is possible to invalidate the detection result in a case where noise from outside is superimposed on the detection signal Vd or the amplitude of the residual vibration is extremely decreased due to some kind of system abnormality. Thus, it is possible to increase the effectiveness of the zero cross detection of the residual vibration even in a case where the attenuation time constant of the detection signal Vd is rather short or in a case where the SN ratio of the detection signal Vd is not favorable. As a result, even in a case where the measuring conditions are poor, it is possible to accurately identify the discharge state and furthermore, it is possible to identify the cause of the discharge abnormality.

Here, in the first embodiment, one high-pass filter HPF1 is used together with n piezoelectric elements 200 as shown in FIG. 17. Here, when the on resistance of the second switch SW2 is Ron and the electrostatic capacitance which has a parasitic effect at the second switch SW2 is Cc, the equivalent circuit of the selection section 352A and the piezoelectric elements 200 which focuses on the detection of the residual vibration is as shown in FIG. 26.

According to the equivalent circuit shown in FIG. 26, n electrostatic capacitances Cc are connected in parallel. Here, when one of the n second switches SW2 is in the on-state, a time constant T is represented by the following formula.

$$T=n\cdot Cc\cdot Ron$$

Here, "n" is preferably set such that the time constant T is shorter than the residual vibration cycle (NTc). It is possible to supply the frequency component of the residual vibration cycle to the high-pass filter HPF1 without greatly attenuating the frequency component using the above settings.

In addition, in a case where the discharge state is abnormal with respect to the residual vibration cycle at the normal time, the residual vibration cycle is long or short. Due to this, "n" is preferably even smaller in order to properly secure the SN ratio in a case where the residual vibration cycle is short at the abnormal time. For example, it is estimated that the residual vibration cycle is the shortest and approximately 1/50 of that of the normal time in a state where there is no ink in the cavity. Since it is possible to determine such an abnormal state according to decreases in the amplitude of the detection signal Vd, it is not necessary to set "n" by estimating the case where the residual vibration cycle is the shortest and it is sufficient if "n" is set such that it is possible to appropriately secure the SN ratio even when the residual vibration cycle is short at approximately 1/5 to 1/10 of that of the normal time in consideration of economic efficiency.

Here, reducing the time constant T by lowering the on resistance Ron of the second switch SW2 is also considered; however, the electrostatic capacity Cc is increased when a transistor with a large gate width is used in order to reduce the on resistance Ron. Due to this, even when the transistor size is increased in order to reduce the on resistance Ron, the time constant T is not always small and there are times when costs are increased due to the chip area being increased.

Thus, it is sufficient if "n", which is the number of the piezoelectric elements 200 which are assigned to one unit, is set so as to appropriately secure the SN ratio of the residual vibration of the piezoelectric elements 200 which is supplied to the high-pass filter HPF1.

Assuming a case where "n" is smaller than the number of the nozzles 241 of the entire ink jet printer 1, it is sufficient if the high-pass filter HPF1, the residual vibration detecting section 356A at the latter stage, and the discharge abnormality detecting section 10 are multiplexed. Since the chip size of the selection section 352A is small even when multiplexed, it is possible to suppress increases in the cost of the entire apparatus while securing the performance.

Second Embodiment

The ink jet printer 1 according to the second embodiment is configured in the same manner as the ink jet printer 1 of the first embodiment except for the point that a selection section 352B is used instead of the selection section 352A and the point that a residual vibration detecting section 356B is used instead of the residual vibration detecting section 356A.

Figure 27:
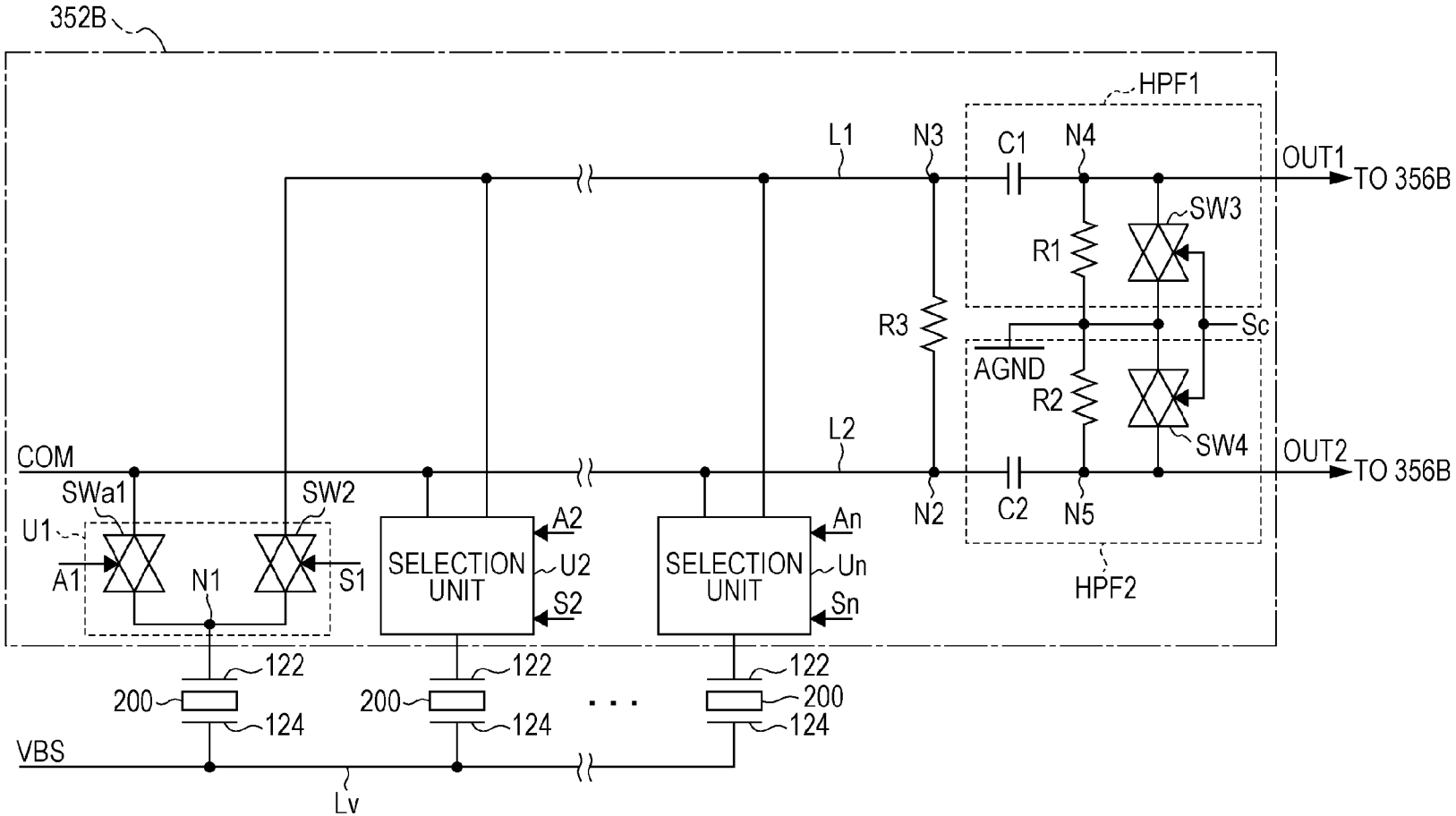
FIG. 27 is a circuit diagram which shows a configuration of a selection section and the plurality of piezoelectric elements according to the second embodiment.

FIG. 27 is a circuit diagram which shows a configuration of the selection section 352B and a plurality of the piezoelectric elements 200. As shown in the diagram, the selection section 352B is provided with n selection units, the third resistor R3, the first high-pass filter HPF1, and a second high-pass filter HPF2. The selection section 352B generates the first output signal OUT1 and a second output signal OUT2 in differential form and outputs these to the residual vibration detecting section 356B. Due to this, the second high-pass filter HPF2 is added to the selection section 352B with respect to the selection section 352A.

The second high-pass filter HPF2 is provided with a second capacitor C2 which is provided between the second node N2 and a fifth node N5; a second resistor R2 where one terminal is connected with the fifth node N5 and the analog ground AGND is supplied to the other terminal; and a fourth switch SW4 which is connected in parallel with the second resistor R2. The fourth switch SW4 is configured at a transfer gate in the same manner as the first switch SWa1, the second switch SW2, and the third switch SW3. In addition, a control signal Sc is supplied to the fourth switch SW4 and the on-state and the off-state are switched at the same timing as the third switch SW3.

That is, the selection section 352B sets a signal of a line L1 with which the second switch SW2 is connected and a signal of a line L2 to which the driving signal COM is supplied as input signals in differential form, and outputs the first and second output signals OUT1 and OUT2, where a low frequency component is attenuated at the first high-pass filter HPF1 and the second high-pass filter HPF2, in differential form to the residual vibration detecting section 356B.

Figure 28:
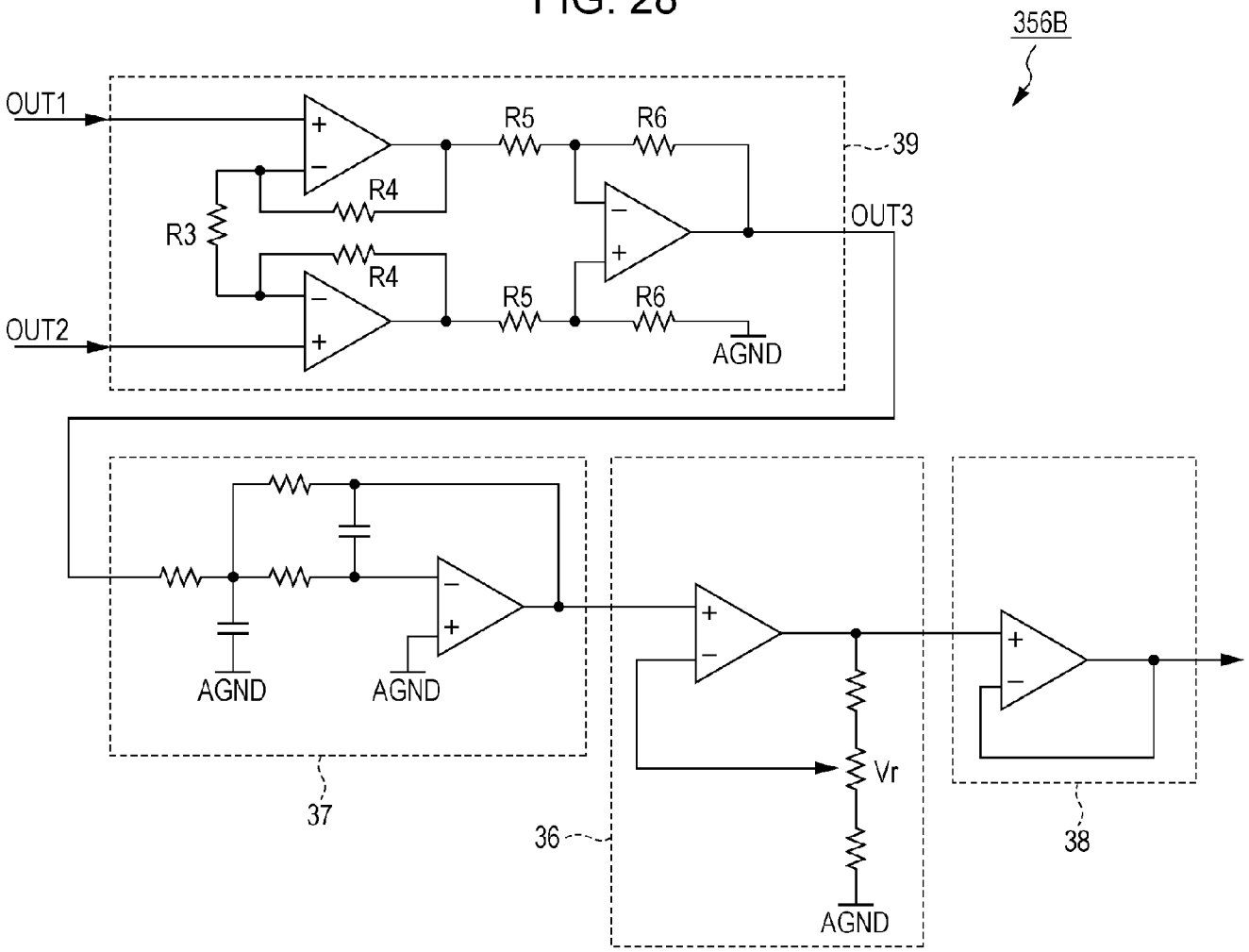
FIG. 28 is a circuit diagram which shows a configuration of a residual vibration detecting section according to the second embodiment.

FIG. 28 shows a configuration of the residual vibration detecting section 356B. The gain adjusting section 36, the low pass filter 37, and the buffer 38 in the residual vibration detecting section 356B are the same as in the residual vibration detecting section 356A of the first embodiment and a differential amplifier section 39 is different. The differential amplifier section 39 is an instrumentation amplifier which is configured using three operational amplifiers. A gain G of the differential amplifier section 39 is given by the following formula.

$$G=OUT3/(OUT1-OUT2)=(1+2*R4/R3)*(R6/R5)$$

Since the differential amplifier section 39 has a high common mode rejection ratio, it is possible to generate an output signal OUT3 in a single end form by suppressing common mode noise even when the common mode noise is introduced to the line of the second node N2 and the line of the third node N3.

The output signal OUT3 is supplied to the discharge abnormality detecting section 10 as a detection signal Vd by the high frequency component being attenuated at the low pass filter 37, the gain being adjusted at the gain adjusting section 36, and the impedance being converted at the buffer 38.

Thus, since the second embodiment is provided with the selection section 352B where the electromotive force of the piezoelectric elements 200 which is caused by the residual vibration is output in differential form and the differential amplifier section 39 where the output signal OUT3 is generated in a single end form while removing the common mode noise which is included in the first and second output signals OUT1 and OUT2 in differential form, it is possible to determine the discharge state more accurately.

Here, in the second embodiment, the selection section 352B treats a signal of the line where the driving signal COM is supplied and a signal of the line where the second switch SW2 is connected as an input signal in differential form; however, the invention is not limited to this and a signal of the line where the driving signal COM is supplied and a signal of the supply line Lv may be treated as an input signal in differential form.

Figure 29:
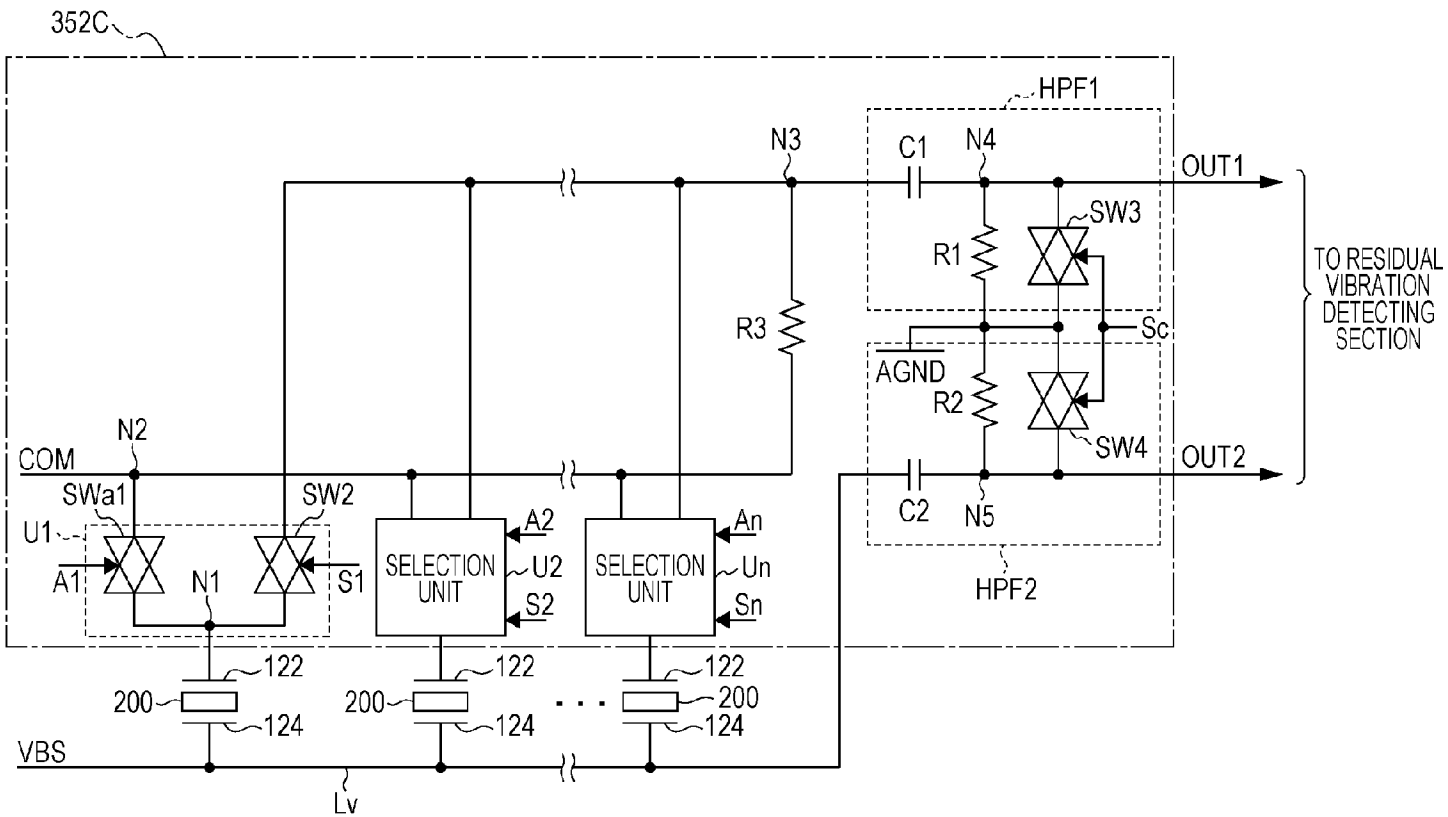
FIG. 29 is a circuit diagram which shows a configuration of a selection section and the plurality of piezoelectric elements according to a modification example of the second embodiment.

FIG. 29 shows a circuit diagram of a selection section 352C according to a modification example of the second embodiment. As shown in the diagram, a fixed potential VBS is supplied to the second high-pass filter HPF2. The electromotive current of the piezoelectric elements 200 which changes according to the residual vibration flows on a path from the piezoelectric elements 200, the second switch SW2, the third resistor R3, the COM line, the supply line Lv, and the piezoelectric elements 200. According to the modification example, it is possible to effectively suppress the common mode noise which is superimposed on the line of the third node N3 and the supply line Lv.

Third Embodiment

The ink jet printer 1 according to the third embodiment is configured in the same manner as the ink jet printer 1 according to the first embodiment except for the point that a selection section 352D is used instead of the selection section 352A and the point that the driving signal generating section 33 generates a first driving signal COMa and a first driving signal COMb.

Figure 30:
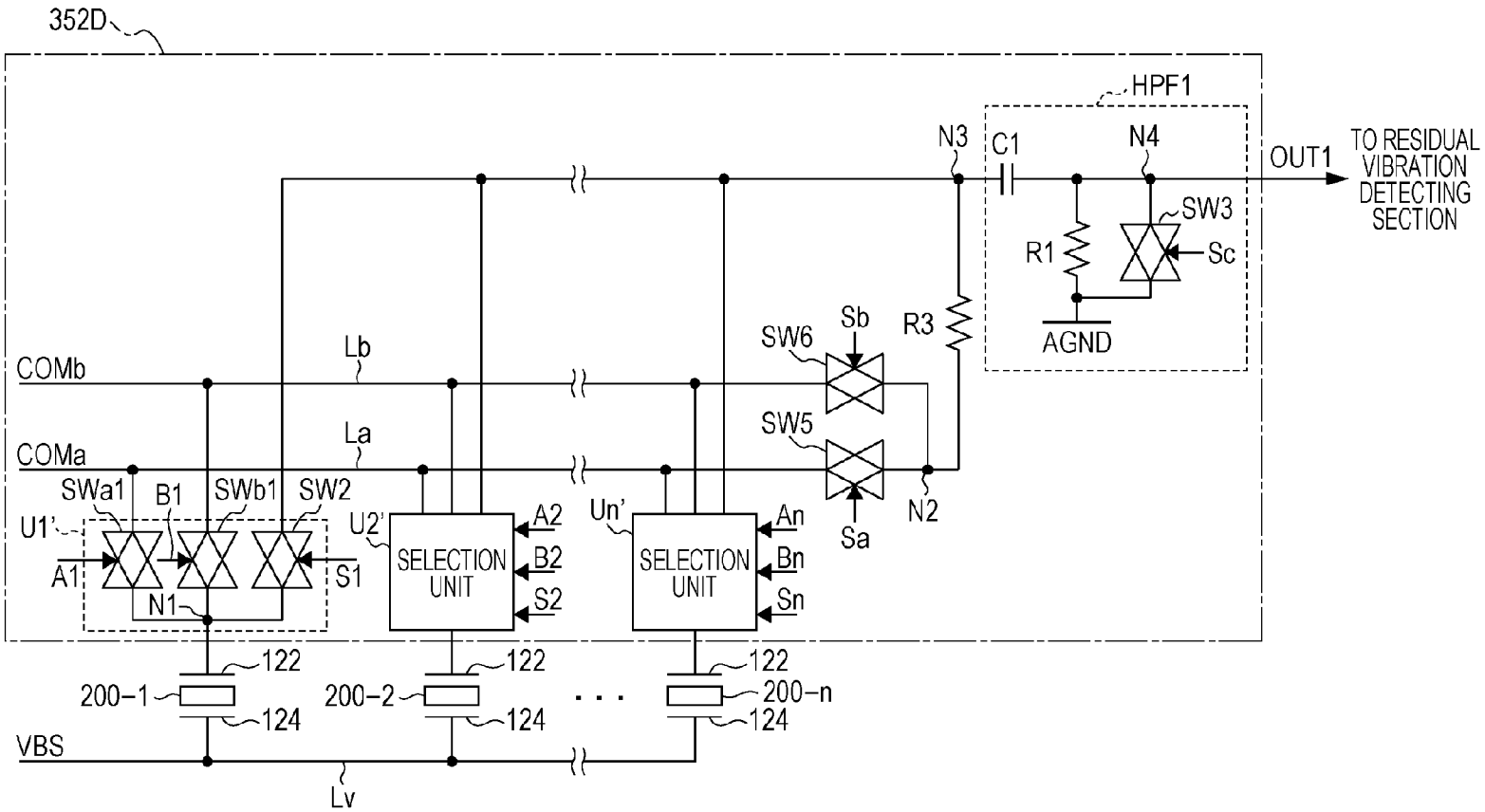
FIG. 30 is a circuit diagram which shows a configuration of a selection section and the plurality of piezoelectric elements according to the third embodiment.

FIG. 30 is a circuit diagram which shows a configuration of the selection section 352D and the plurality of piezoelectric elements 200. As shown in the diagram, the selection section 352D is provided with n selection units U1' to Un', the third resistor R3, the first high-pass filter HPF1, a fifth switch SW5, and a sixth switch SW6. In the third embodiment, the piezoelectric elements 200 are driven using two types of driving signals. Due to this, it is also possible to discharge ink droplets with different sizes from the nozzles 241 by applying various types of driving pulses to the piezoelectric elements 200.

The selection unit U1' is provided with the first switch SWa1 for the first driving signal COMa, a first switch SWb1 for the second driving signal COMb, and the second switch SW2, and the first switch SWb1 for the second driving signal COMb is added with respect to the selection unit U1. Here, the other selection units U2' to Un' are configured in the same manner as the selection unit U1'.

In addition, the fifth switch SW5 is provided between the second node N2 and the supply line La of the first driving signal COMa, and the sixth switch SW6 is provided between the second node N2 and the supply line Lb of the second driving signal COMb. The fifth switch SW5 is in the on-state when the control signal Sa is the high level and in the off-state when the control signal Sa is the low level. In addition, the sixth switch SW6 is in the on-state when the control signal Sb is the high level and in the off-state when the control signal Sb is the low level.

Figure 31:
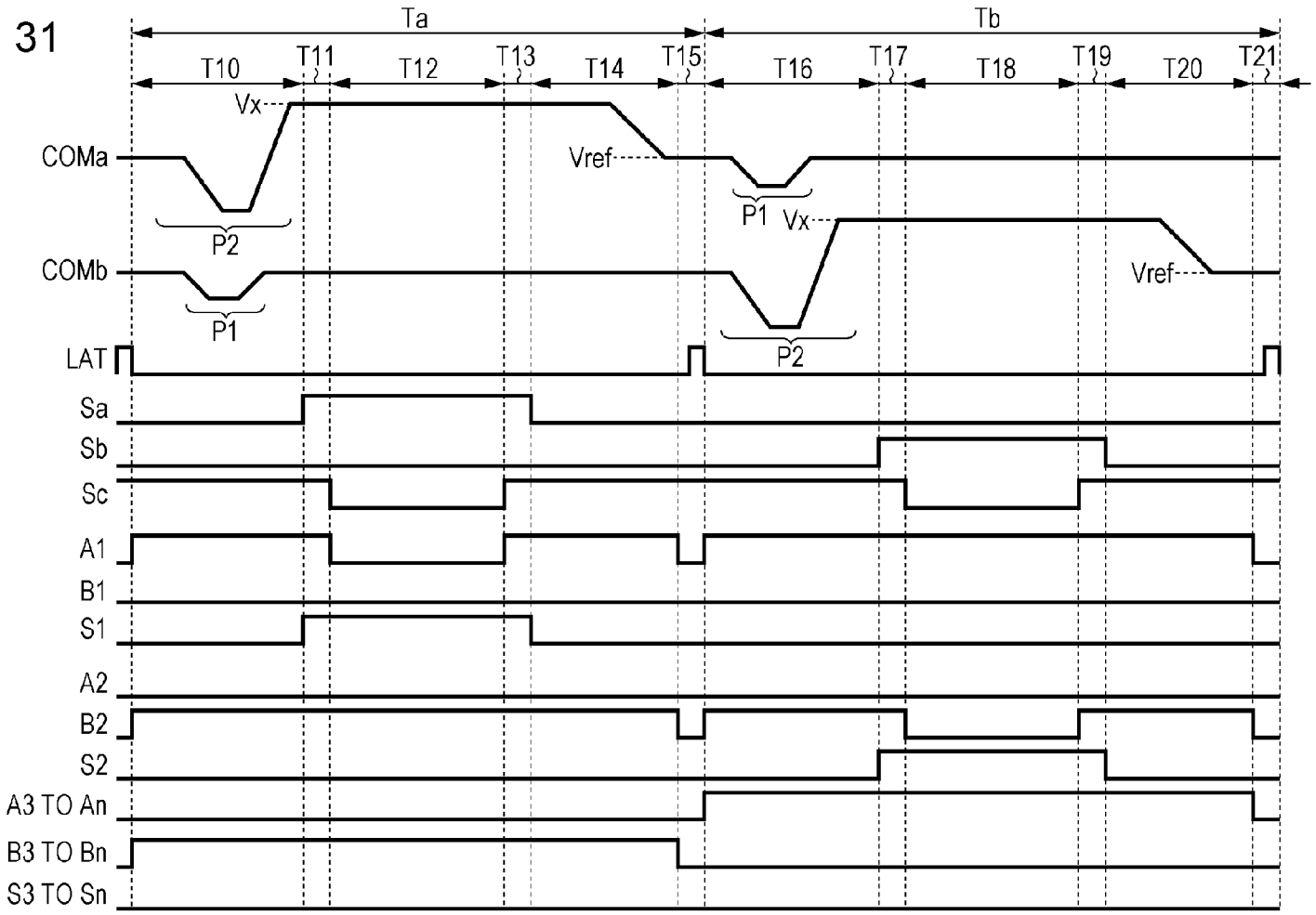
FIG. 31 is a timing chart which shows an operation of the selection section.

FIG. 31 shows a timing chart of the selection section 352D. The first driving signal COMa in the example includes the inspection pulse P2 in a period T10, is a predetermined potential Vx from a period T11 to a period T13, decreases from the predetermined potential Vx to a reference potential Vref during a period T14, maintains the reference potential Vref during a period T15, includes the micro-vibration pulse P1 during a period T16, and maintains the reference potential Vref from a period T17 to a period T20.

On the other hand, the second driving signal COMb includes the micro-vibration pulse P1 during the period T10, maintains the reference potential Vref from the period T11 to a period T15, includes the inspection pulse P2 during the period T16, maintains the predetermined potential Vx from the period T17 to a period T19, and decreases from the predetermined potential Vx to the reference potential Vref during the period T20.

That is, the first driving signal COMa during the first unit period Ta and the second driving signal COMb during the next unit period Tb are the same, and the first driving signal COMa during the next unit period Tb and the second driving signal COMb during the first unit period Ta are the same.

In the example, during the first unit period Ta, the inspection pulse P2 is applied to the piezoelectric elements 200 which are connected with the selection unit U1' and the residual vibration is detected during a period T12. In addition, during the next unit period Tb, the inspection pulse P2 is applied to the piezoelectric elements 200 which are connected with the selection unit U2' and the residual vibration is detected during a period T18. In addition, the micro-vibration pulse P1 is applied to the piezoelectric elements 200 which correspond to the other selection units U3' to Un' during the unit periods Ta and Tb.

Firstly, during the period T10, the control signal A1 is high level, the first switch SWa1 for the first driving signal COMa is in the on-state, and the inspection pulse P2 of the first driving signal COMa is supplied to a piezoelectric element 200-1. In addition, in the selection unit U2', the control signal B2 is high level, the first switch SWb1 for the second driving signal COMb is in the on-state, and the micro-vibration pulse P1 of the second driving signal COMb is supplied to a piezoelectric element 200-2. In addition, since the control signals B3 to Bn are high level in the selection units U3' to Un', the first switch SWb1 for the second driving signal COMb is in the on-state and the micro-vibration pulse P1 is supplied to piezoelectric elements 200-3 to **120-*n***.

Next, during the period T12, the control signals S1 and Sa are high level, and the second switch SW2 and the fifth switch SW5 of the selection unit U1' are in the on-state. In addition, since the control signals Sc, A1, and B1 are low level, the first switches SWa1 and SWb1 and the third switch SW3 of the selection unit U1' are in the off-state. Due to this, the electromotive force which is generated in the piezoelectric element 200-1 is transferred on the path through the second switch SW2, the third node N3, the first capacitor C1, and the fourth node N4, and is output as the first output signal OUT1. At this time, the potential of the third node N3 is biased to the predetermined potential Vx of the first driving signal COMa by the third resistor R3.

In addition, during the period T11 which is directly before the period T12 and the period T13 which is directly after the period T12, the control signals Sa, Sc, A1, and S1 are high level. Due to this, in the first selection unit U1', the first switch SWa1 and the second switch SW2 are in the on-state, and the fifth switch SW5 and the third switch SW3 are in the on-state. Thus, by the first switch SWa1 and the second switch SW2 being in the on-state at the same time, the potential of the third node N3 changes and it is possible to suppress the generation of switching noise. In addition, since the third switch SW3 is in the on-state, the potential of the fourth node N4 is clamped by the analog ground AGND. Due to this, it is possible to prevent the switching noise from being superimposed on the first output signal OUT1.

Next, during the period T14, since the control signal A1 is high level and the first switch SWa1 is in the on-state, the first driving signal COMa is supplied to the piezoelectric element 200-1. As a result, the potential of the first electrode 122 of the piezoelectric element 200-1 returns to the reference potential Vref.

Thus, the residual vibration of the head which corresponds to the piezoelectric element 200-1 is measured using the first driving signal COMa during the initial unit period Ta. At this time, since the first switch SWb1 for the second driving signal COMb of the second selection unit U2' is in the on-state, the second driving signal COMb is supplied to the piezoelectric element 200-2.

Next, during the unit period Tb, each of the period T16 to a period T21 corresponds to each of the period T10 to the period T15 during the unit period Ta. Specifically, the control signal Sa during the unit period Tb is the same as the control signal Sb during the unit period Ta, the control signal Sb during the unit period Tb is the same as the control signal Sa during the unit period Ta, the control signal Sc during the unit period Tb is the same as the control signal Sc during the unit period Ta, the control signal A1 during the unit period Tb is the same as the control signal B2 during the unit period Ta, the control signal B1 during the unit period Tb is the same as the control signal B1 during the unit period Ta, the control signal S1 during the unit period Tb is the same as the control signal S2 during the unit period Ta, the control signal A2 during the unit period Tb is the same as the control signal A2 during the unit period Ta, the control signal B2 during the unit period Tb is the same as the control signal A1 during the unit period Ta, and the control signal S2 during the unit period Tb is the same as the control signal S1 during the unit period Ta.

Accordingly, during the period Tb, the residual vibration is detected by selecting the second driving signal COMb in the selection unit U2', applying the inspection pulse P2 to the piezoelectric element 200-2, and using the piezoelectric element 200-2.

In this manner, in the third embodiment, it is possible to detect the residual vibration and determine the discharge state of the ink droplets by using the first driving signal COMa and the second driving signal COMb.

In addition, it is necessary that the micro-vibration pulse P1 and the inspection pulse P2 be included during one unit period since one type of driving signal COM is used in the first embodiment; however, in the present embodiment, it is sufficient if the micro-vibration pulse P1 is included in one of the first driving signal COMa or the second driving signal COMb during each of the unit periods and the inspection pulse P2 is included in the other. As a result, it is possible to shorten the unit periods Ta and Tb.

Here, in the embodiment described above, the inspection pulse P2 is included in the first driving signal COMa and the micro-vibration pulse P1 is included in the second driving signal COMb during the period T10; however, a discharge pulse which discharges ink droplets may be included instead of the micro-vibration pulse P1. In this case, it is possible for the nozzles 241 which discharge ink droplets and the nozzles 241 which detect the residual vibration as non-discharging of the ink droplets to coexist.

Fourth Embodiment

The ink jet printer 1 according to the fourth embodiment is configured in the same manner as the ink jet printer 1 of the third embodiment except for the point that a selection section 352E is used instead of the selection section 352D.

Figure 32:
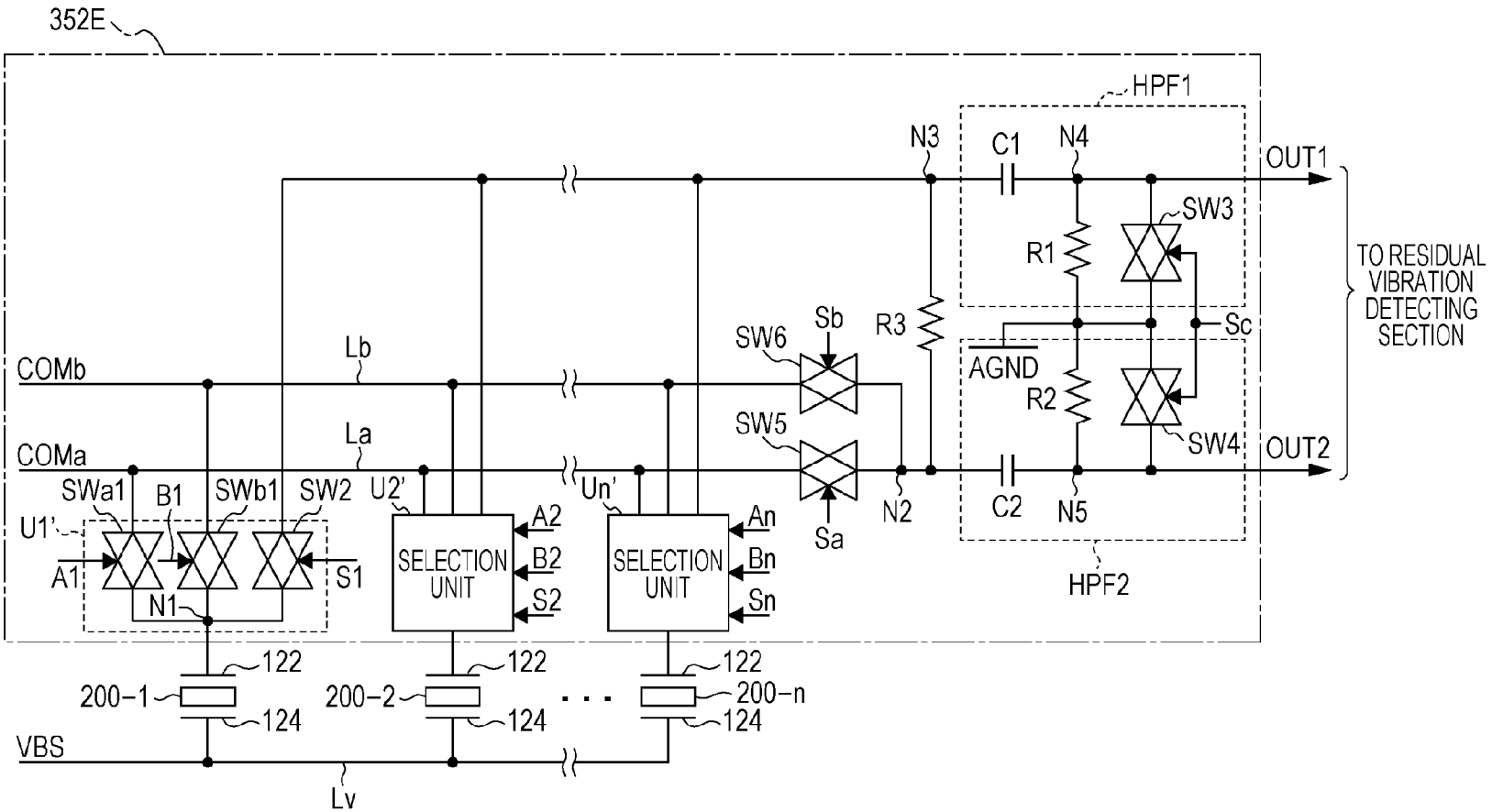
FIG. 32 is a circuit diagram which shows a configuration of a selection section and the plurality of piezoelectric elements according to the fourth embodiment.

FIG. 32 is a circuit diagram which shows a configuration of the selection section 352E and a plurality of the piezoelectric elements 200. As shown in the diagram, the selection section 352E has a configuration where the second high-pass filter HPF2 is added to the selection section 352D of the third embodiment described above. Due to this, the selection section 352E outputs the first output signal OUT1 and the second output signal OUT2 in differential form to the residual vibration detecting section 356B (refer to FIG. 28). Since the residual vibration detecting section 356B is provided with the differential amplifier section 39 where the output signal OUT3 is generated in a single end form while removing the common mode noise which is included in the first and second output signals OUT1 and OUT2 in differential form, it is possible to determine the discharge state more accurately.

Here, in the fourth embodiment, the selection section 352E treated a signal of the supply line La or Lb and a signal of the line where the second switch SW2 is connected as an input signal in differential form; however, the invention is not limited to this and the signal of the supply line La or Lb and the signal of the supply line Lv may be treated as an input signal in differential form.

Figure 33:
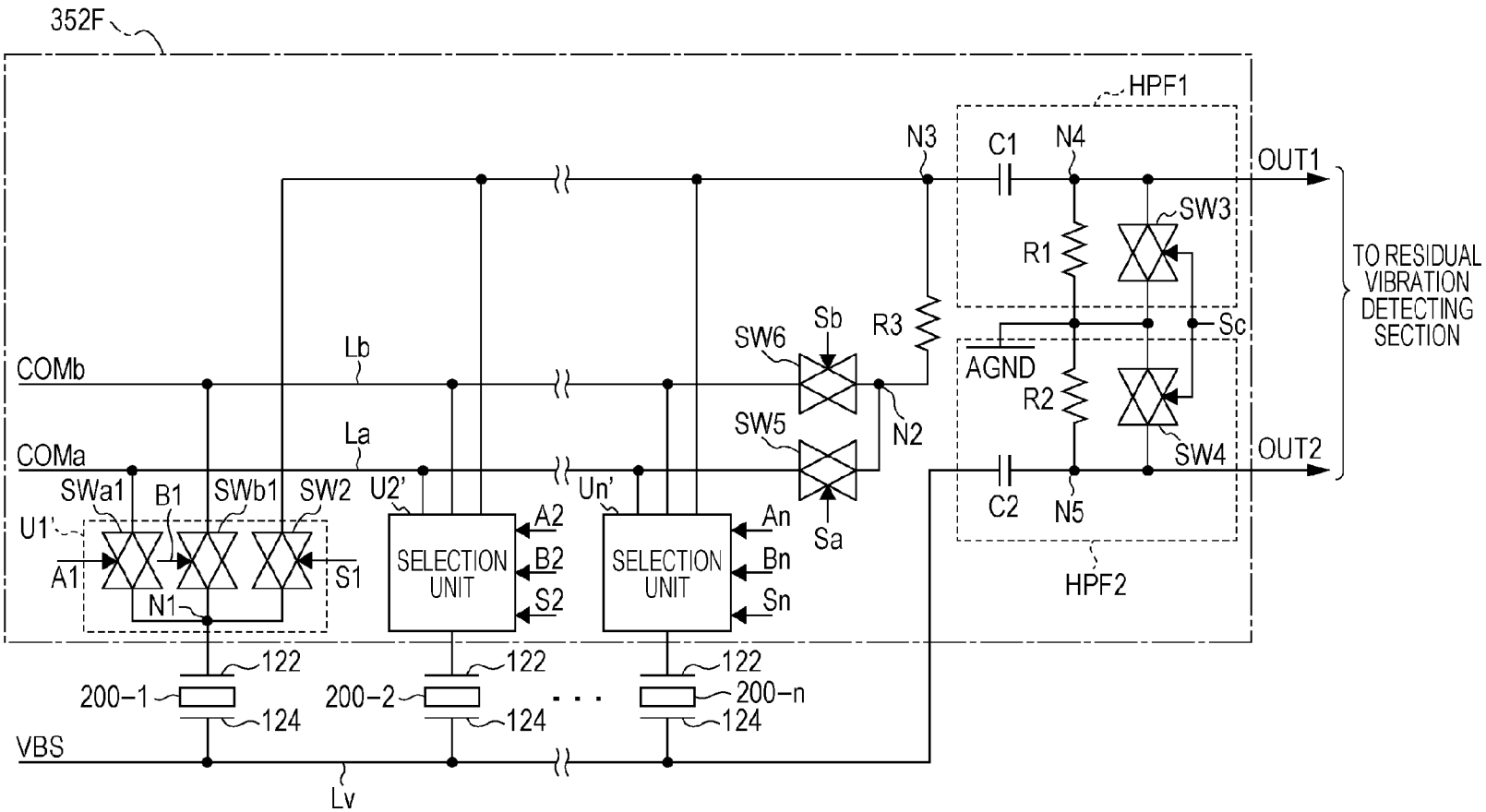
FIG. 33 is a circuit diagram which shows a configuration of a selection section and the plurality of piezoelectric elements according to a modification example of the fourth embodiment.

FIG. 33 shows a circuit diagram of a selection section 352F according to the modification example of the fourth embodiment. As shown in the diagram, a fixed potential VBS is supplied to the second high-pass filter HPF2. According to the modification example, it is possible to effectively suppress the common mode noise which is superimposed on the line of the third node N3 and the supply line Lv.

MODIFICATION EXAMPLES

The invention is not limited to each of the embodiments described above and, for example, various types of modification examples are possible as described below. In addition, in each of the modification examples, modification examples may be appropriately combined with one another and may be further combined with each of the embodiments described above as appropriate.

(1) Modification Example 1

In each of the embodiments described above, the selection sections 352A to 352F and the residual vibration detecting sections 356A and 356B are stored in one IC chip; however, the invention is not limited to this and the former stage of the third resistor R3 may be mounted on the head unit 35 by being integrated into one chip and the configuration of the latter stage which includes the third resistor R3 may be provided in another substrate.

Figure 34:
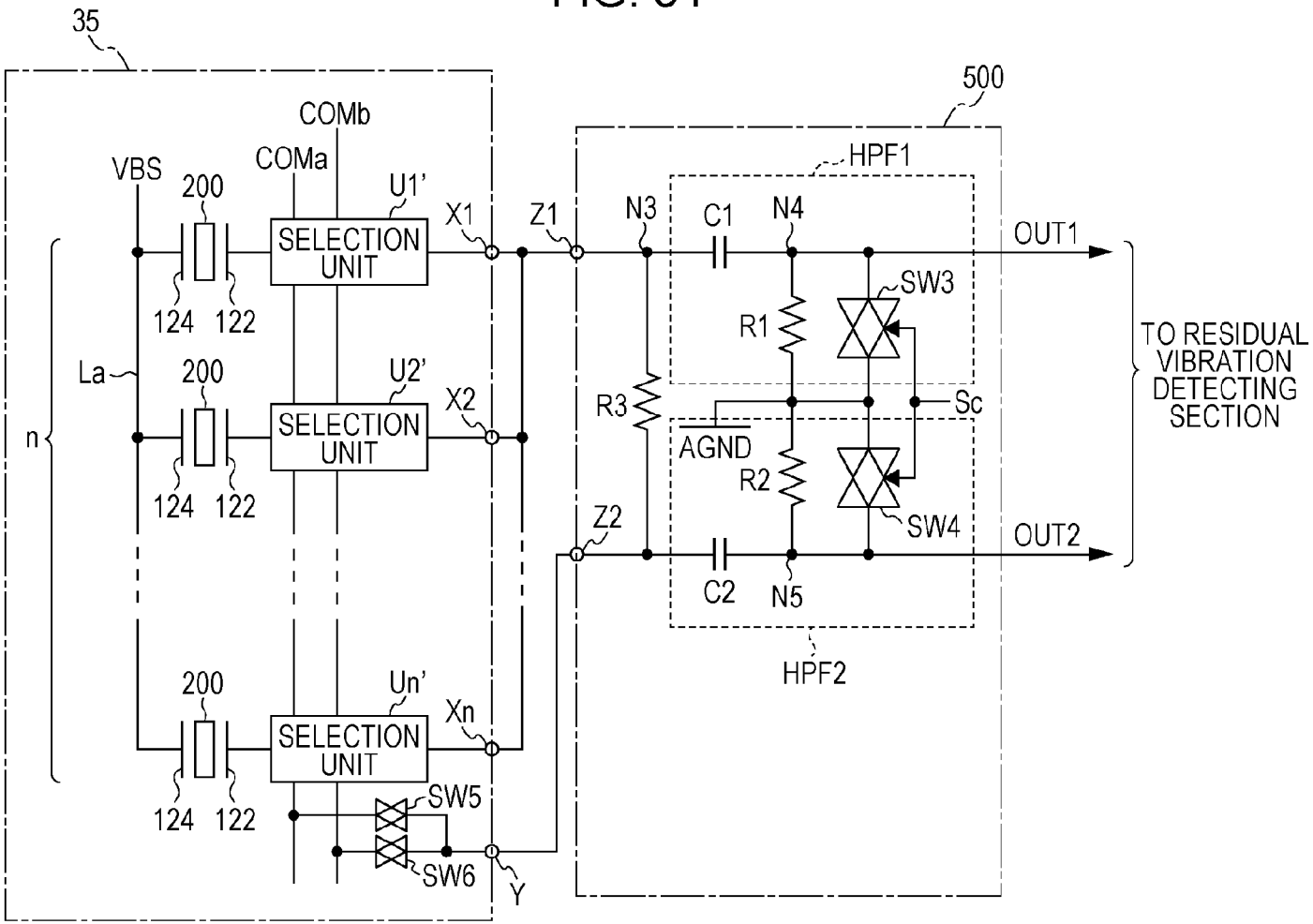
FIG. 34 is a circuit diagram which shows a configuration of the selection section according to modification example 1.

For example, a case of application to the selection section 352E shown in the fourth embodiment is as shown in FIG. 34. As shown in the same diagram, the terminals X1 to Xn, which are provided corresponding to each of the selection units U1' to Un', and the terminal Y where the fifth switch SW5 and the sixth switch SW6 are connected are provided in the head unit 35. On the other hand, a circuit substrate 500 is provided with the third resistor R3, a terminal Z1 which is connected with the terminal X1 to terminal Xn via a flexible substrate or the like which is not shown in the diagram, a terminal Z2 which is connected with the terminal Y, and the like.

Here, as described in the first embodiment, in a case where the number "n" of the piezoelectric elements 200 where the high-pass filters HPF1 and HPF2 are used together is limited due to the influence of the electrostatic capacity Cc, it is sufficient if the configuration of the latter stage which includes the third resistor R3 is multiplexed.

(2) Modification Example 2

In each of the embodiments described above, the clamping is released by transitioning the third switch SW3 (the fourth switch SW4) from the on-state to the off-state at the same time as transitioning the first switch SWa1 (SWb1) from the on-state to the off-state; however, the invention is not limited to this and the clamping may be released by transitioning the third switch SW3 (the fourth switch SW4) from the on-state to the off-state after transitioning the first switch SWa1 (SWb1) from the on-state to the off-state.

In addition, the clamping is carried out by transitioning the third switch SW3 (the fourth switch SW4) from the off-state to the on-state at the same time as transitioning the first switch SWa1 (SWb1) from the off-state to the on-state; however, the invention is not limited to this and the first switch SWa1 (SWb1) may be transitioned from the off-state to the on-state after the clamping operation is carried out by transitioning the third switch SW3 (the fourth switch SW4) from the off-state to the on-state.

According to this control, it is possible to reliably prevent the driving signal COM being directly supplied to the residual vibration detecting section without using the third resistor R3.

(3) Modification Example 3

The invention is not limited to the ink jet head described in each of the embodiments described above and there may of course be other configuration examples. FIG. 35 to FIG. 38 are each cross-sectional diagrams which show schematics of other configuration examples of an ink jet head (a head unit). Below, description will be given based on these diagrams; however, the description will focus on the points which are different from the embodiments described above and description of the same matters will be omitted.

Figure 35:
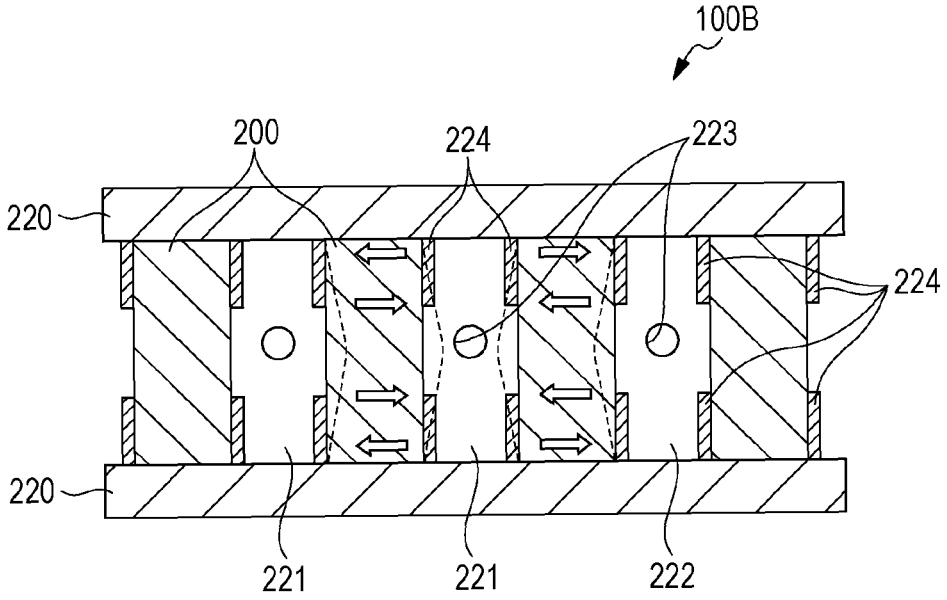
FIG. 35 is a cross-sectional diagram which shows schematics of another configuration example of an ink jet head in the invention.

In an ink jet head 100B shown in FIG. 35, ink (liquid) inside a cavity 221 is discharged from the nozzles by the driving of the piezoelectric elements 200. The ink jet head 100B has a pair of substrates 220 which oppose each other and a plurality of the piezoelectric elements 200 are intermittently arranged between the substrates 220 at predetermined intervals.

The cavity 221 is formed between the piezoelectric elements 200 which are adjacent. A plate (which is not shown in the diagram) is arranged to the front of the cavity 221 in FIG. 35, a nozzle plate 222 is arranged to the rear, and nozzles (holes) 223 are formed at positions which correspond to each of the cavities 221 of the nozzle plate 222.

A pair of electrodes 224 are respectively arranged on one surface and the other surface of each of the piezoelectric elements 200. That is, four electrodes 224 are bonded with respect to one piezoelectric element 200. By applying a predetermined driving voltage waveform between predetermined electrodes out of these electrodes 224, the piezoelectric elements 200 vibrate by changing shape in a share-mode (shown with an arrow in FIG. 35), the volume of the cavity 221 (the pressure inside the cavity) changes due to the vibration, and ink (liquid) which is filled inside the cavity 221 is discharged from the nozzles 223 as liquid droplets. That is, the piezoelectric element 200 itself functions as a diaphragm in the ink jet head 100B.

Figure 36:
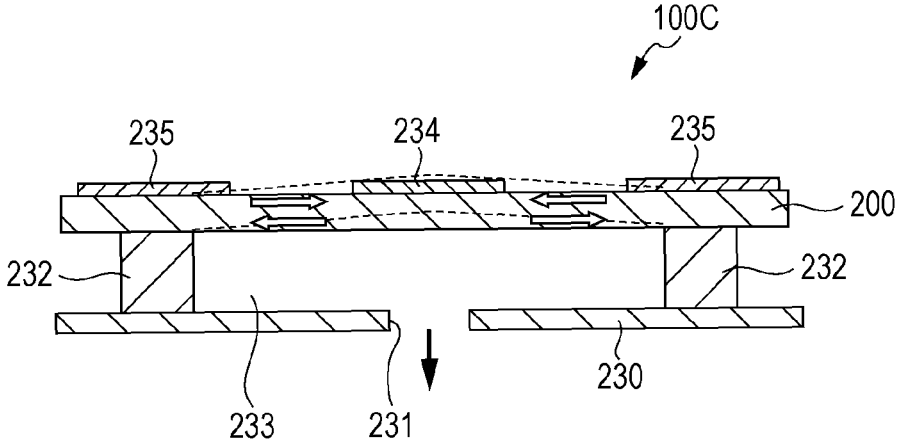
FIG. 36 is a cross-sectional diagram which shows schematics of another configuration example of an ink jet head in the invention.

In the same manner as above, an ink jet head 100C shown in FIG. 36 also discharges ink (liquid) inside a cavity 233 from nozzles 231 according to the driving of the piezoelectric elements 200. The ink jet head 100C is provided with a nozzle plate 230 where the nozzles 231 are formed, a spacer 232, and the piezoelectric elements 200. The piezoelectric elements 200 are arranged to be separated at a predetermined distance via the spacer 232 with respect to the nozzle plate 230 and the cavity 233 is formed in the space which is surrounded by the nozzle plate 230, the piezoelectric elements 200, and the spacer 232.

A plurality of electrodes are bonded with the upper surface of the piezoelectric elements 200 in FIG. 36. That is, a first electrode 234 is bonded with an approximately central section of the piezoelectric element 200 and each of the second electrodes 235 is bonded with both side sections thereof. By applying the predetermined driving voltage waveform between the first electrode 234 and the second electrode 235, the piezoelectric elements 200 vibrate by changing shape in a share-mode (shown with an arrow in FIG. 36), the volume of the cavity 233 (the pressure inside the cavity) changes due to the vibration, and ink (liquid) which is filled inside the cavity 233 is discharged from the nozzles 231 as liquid droplets. That is, the piezoelectric element 200 itself functions as a diaphragm in the ink jet head 100C.

(4) Modification Example 4

In each of the embodiments described above, description is given using a serial printer where the main scanning direction of the head and the sub-scanning direction of the paper feeding are different as an example; however, the invention is not limited to this and a line printer where the width of the head is the width of the paper may be used. Since it is possible to execute the determination of the discharge state according to the residual vibration without discharging ink onto the paper, it is possible to perform the inspection of the discharge state during printing in the line printer.

(5) Modification Example 5

The third resistor R3 which biases the third node N3 is provided in each of the embodiments described above;

however, the invention is not limited to this and the third resistor R3 need not be provided. Even in this case, it is possible to operate the residual vibration detecting section 356A of the latter stage at a low voltage since the direct current component is cut by the first capacitor C1.

(6) Modification Example 6

The potential of the fourth node N4 is clamped by the analog ground AGND using the third switch SW3 in each of the embodiments described above; however, the invention is not limited to this and the third switch SW3 (and the fourth switch SW4) need not be used. That is, clamping other than during periods when the residual vibration is detected is not essential as long as the residual vibration detecting section 356A of the latter stage allows input of a signal with a high amplitude. For example, in a case where a limiter circuit which limits the amplitude of an input signal is provided at the input stage of the residual vibration detecting section 356A, it is possible to operate the residual vibration detecting section 356A normally without clamping using the third switch SW3.

The entire disclosure of Japanese Patent Application No. 2013-172709, filed Aug. 22, 2013 is expressly incorporated by reference herein.

What is claimed is:

1. A liquid discharging apparatus comprising:

a nozzle which discharges liquid droplets;

a pressure chamber which communicates with the nozzle;

a piezoelectric element which is provided corresponding to the pressure chamber in order to discharge the liquid droplets;

a driving signal generating section which generates a driving signal for driving the piezoelectric element so as to provide an electromotive force;

a first high-pass filter which includes a first capacitor and a first resistor, the first high-pass filter receives changes in the electromotive force from the piezoelectric element;

a residual vibration detecting section which detects the changes, in the electromotive force of the piezoelectric element in accordance with residual vibration inside the pressure chamber, which occur after the driving signal is applied, the residual vibration detecting section generating a detection signal corresponding to the changes in the electromotive force;

a first switch which selectively provides the driving signal to the piezoelectric element;

a second switch which selectively provides the changes in the electromotive force to the first high-pass filter;

a first node which electrically connects the piezoelectric element, the first switch, and the second switch;

a second node which electrically connects the driving signal generating section and the first switch; and a third node which electrically connects the second switch and the first high-pass filter, wherein a discharged ink droplet state is determined based on the detection signal.

2. The liquid discharging apparatus according to claim 1, further comprising:

a second resistor which is electrically connected between the second node and the third node.

3. The liquid discharging apparatus according to claim 1, wherein the residual vibration detecting section is provided with a low pass filter which attenuates a high frequency component of a first output signal that passes through the first high-pass filter.

4. The liquid discharging apparatus according to claim 1, further comprising:

a second high-pass filter which includes a second capacitor and a second resistor, wherein the residual vibration detecting section is provided with a differential amplifier which has a positive input terminal and a negative input terminal, one of a first output signal which passes through the first high-pass filter and a second output signal which passes through the second high-pass filter is supplied to the positive input terminal of the differential amplifier and the other of the first output signal and the second output signal is supplied to the negative input terminal of the differential amplifier, and the driving signal or a fixed potential which is supplied to the piezoelectric element is input to the second high-pass filter.

* * * * *